US005820404A

United States Patent [19]

Chishima et al.

[11] Patent Number: 5,820,404

[45] Date of Patent: Oct. 13, 1998

[54] TERMINAL AND CRAMPING CONNECTOR

[75] Inventors: Masamitsu Chishima; Satomi Seko, both of Yokkaichi, Japan

[73] Assignee: Sumitomo Wiring Systems, Ltd., Japan

[21] Appl. No.: 677,618

[22] Filed: Jul. 8, 1996

[30] Foreign Application Priority Data

| | | | |
|---|---|---|---|
| Jul. 10, 1995 | [JP] | Japan | 7-198132 |
| Aug. 2, 1995 | [JP] | Japan | 7-218070 |
| Oct. 3, 1995 | [JP] | Japan | 7-282499 |
| Mar. 5, 1996 | [JP] | Japan | 8-047123 |

[51] Int. Cl.[6] ..... H01R 4/24

[52] U.S. Cl. ..... 439/417; 439/404

[58] Field of Search ..... 439/417, 418, 439/403, 404, 405, 402, 395

[56] References Cited

U.S. PATENT DOCUMENTS

| | | | |
|---|---|---|---|
| 4,283,103 | 8/1981 | Forberg et al. | 439/404 |
| 4,533,196 | 8/1985 | Forberg et al. | 439/404 |
| 4,533,199 | 8/1985 | Feldberg | 439/404 |
| 4,988,311 | 1/1991 | Tanzola | 439/404 |
| 5,199,899 | 4/1993 | Ittah | 439/403 |
| 5,562,478 | 10/1996 | Yamamoto | 439/417 |

FOREIGN PATENT DOCUMENTS

| | | | |
|---|---|---|---|
| 0 478 400 | 4/1992 | European Pat. Off. . | |
| 6-62468 | of 1994 | Japan . | |
| 7-18357 | of 1995 | Japan . | |
| 7-78641 | of 1995 | Japan . | |
| 2141593 | 12/1984 | United Kingdom | 439/404 |

*Primary Examiner*—Gary F. Paumen
*Assistant Examiner*—Tho D. Ta
*Attorney, Agent, or Firm*—Anthony J. Casella; Gerald E. Hespos; Ludomir A. Budzyn

[57] ABSTRACT

To ensure a wire arrangement with an improved degree of freedom and in a compact manner. A terminal 10 is formed by bending the opposite ends of a strip 11 in the same direction by different lengths to form two blade portions 12*a*1, 12*b*1 of different heights such that slits formed in the blade portions 12*a*1, 12*b*1 are aligned with respect to the longitudinal direction of wires to be connected. In a lower casing accommodating the terminals 10, branch wires 50 are placed and retained on the lower blade portions 12*b*1. In an upper casing 40 for covering the lower casing 30, main wires 60 are so retained as to face the higher blade portions 12*a*1 when the upper casing 40 is fitted to cover the lower casing 30. When the upper casing 40 is fitted on the lower casing 30, the main wires 60 retained by the upper casing 40 are pressed into the slits of the blade portions 12*a*1 to be connected therewith, and press the branch wires 50 placed on the blade portions 12*b*1 in the lower casing 30 into the slits of the blade portions 12*b*1 so that the branch wires 50 are connected with the blade portions 12*b*1. Thus, the connected wires 50, 60 can be arranged one over the other in a compact manner.

11 Claims, 22 Drawing Sheets

TERMINAL AND CRAMPING CONNECTOR

BACKGROUND OF THE INVENTION

1. Field of the Invention. The present invention relates to a terminal and to a cramping connector and, particularly to a cramping connector in which a plurality of blade portions are held such that slits thereof open in the same direction.

2. Description of the Prior Art. In a known cramping terminal of this type, slit-like parallel blade portions are formed in flat metal strips in order to arrange terminals provided with the blade portions perpendicularly to two parallelly arranged wires. The respective blade portions are formed to have the same height, and are arranged side by side in the case of connecting a plurality of wires.

With the above prior art cramping connector, since the wires to be connected are only arranged side by side, there are not a wide range of applications. Further, the arrangement of the wires, as a whole, is invariably wide.

A known cramping terminal of this type is a double-sided cramping terminal disclosed in Japanese Unexamined Utility Model Publication No. 6-62468 shown in FIG. 37.

In this double-sided cramping terminal, separately formed upper and lower covers 2, 3 are fittable to a plate-like housing 1 from above and below, respectively. Fittings 4 are so pressed into the housing 1 as to project from the upper and lower surfaces of the housing 1. Wires 5 are pressed to be connected with the fittings 4 on the upper and lower surfaces of the housing 1. Specifically, the wires are arranged on the upper surface of the housing 1 and the upper cover 2 is fitted to press the wires to be connected with the fittings 4 after being positioned. Subsequently, the housing 1 is turned upside down. Wires are arranged in a similar manner, and the lower cover 3 is fitted to press the wires to be connected with the fittings 4.

With the above double-sided cramping connector, the connection operation is cumbersome because the wires have to be connected in order, i.e. first on the upper surface and then on the lower surface or vice versa, and the housing has to be turned upside down in the middle of the operation.

In view of the above problem, a further object of the invention is to provide a terminal or a cramping connector having an improved wire arrangement operability.

In view of the above problems, an object of the present invention is to provide a terminal or a cramping connector which ensures a wire arrangement with an improved degree of freedom and/or in a compact manner.

SUMMARY OF THE INVENTION

According to the invention, there is provided a terminal for a cramping connector, comprising a plurality of blade portions, in particular blade parts being arranged at or having different heights or depths.

According to a preferred embodiment, the blade portions are shifted along forward and backward directions.

According to the invention, there is further provided a terminal for a cramping connector, comprising a plurality of blade portions, in particular blade parts being shifted along forward and backward directions and being arranged at or having same heights.

According to a further preferred embodiment of the invention, the blade portions extend in substantially a same direction, wherein the blade portions are preferably arranged at an angle, in particular substantially normal with respect to each other.

Preferably, the terminal comprises three or more blade portions.

Further preferably, the blade portions are shifted along a lateral direction being in particular perpendicular with respect to an inserting direction of a wire into the blade portions.

Still further preferably, the terminal further comprises two or more slits, wherein the slits are formed in the opposite ends of a strip from front end portions thereof and wherein the strip is bent at least once at the opposite ends thereof substantially at an angle, in particular at a right angle in the same direction by different lengths and/or wherein the slits are formed on portions of a strip from the lateral side thereof and wherein the strip is bent at an angle along a direction substantially in parallel to the slits, the slits having a different length and/or the side portions of the strips being stepped.

Most preferably, the height difference of the blade portions is substantially equal to or greater than the thickness of the wires.

According to the invention, there is further provided a cramping connector, comprising: at least one terminal, in particular at least one terminal according to the invention, having a plurality blade portions, in particular blade parts arranged on a same plane, and a housing for retaining the terminal and for positioning a plurality of wires, in particular one over the other, such that the wires are pressed into the corresponding blade portions, in particular blade parts, when the housing is formed or assembled.

According to a preferred embodiment of the invention, the housing comprises at least a pair of casings.

Preferably, the plurality of wires is positioned such that, ends of branch wires of the plurality of wires face the blade portions at one side and that main wires of the plurality of wires are inserted between the blade portions at the one side and face the blade portions at the other side, wherein the respective wires are pressed into the corresponding blade portions when the housing, in particular when the pair of casings is assembled.

Further preferably, the housing comprises first grooves for accommodating wires to be connected with first blade portions having substantially the same height, the first grooves intersecting under an angle between 0° and 180°, preferably about 45°, 60°, 90°, 120° and/or 135°, with at least second grooves for wires to be connected with second blade portions having one or more heights different than the first grooves, the terminals being particularly mounted at the intersections of the grooves, and/or wherein the housing comprises wire pressing portions which come into contact with the wires so as to press the wires into the blade portions.

Most preferably, the blade portions are obliquely arranged in the housing.

According to a preferred embodiment of the invention, there is provided a cramping connector, comprising at least one terminal comprising a plurality of blade parts and/or blade portions being arranged at or having different heights, and a housing for accommodating and/or retaining the terminal such that wires are connected, in particular pressed to be connected with the blade parts and/or blade portions.

According to a preferred embodiment of the invention, the housing retains a main wire and a branch wire branched from the main wire in its intermediate position, in particular one over the other, the first grooves intersecting under an angle between 0° and 180°, preferably about 45°, 60°, 90°, 120° and/or 135°, with at least second grooves for wires to be connected with second blade portions of other heights than the first grooves, particularly in a manner similar to that of a network and, the terminals being particularly mounted at the intersections of the grooves, and/or wherein the housing comprises wire pressing portions which come into contact with the wires so as to press the wires into the blade portions.

Preferably, the terminal is formed by bending a metal strip, particularly in V-shape, so as to form surfaces intersecting, in particular substantially perpendicular to the longitudinal directions of the wires to be connected and in particular wherein the terminal comprises a slit in each surface from an edge, wherein the edge having a steplike contour.

According to still a further embodiment, the blade portions are displaced with respect to forward and backward directions, the housing comprising a first casing for arranging and/or retaining the terminals, in particular side by side while orienting the terminals in the same direction, and retaining branch wires by placing them, particularly ends thereof on first blade portions, and a second casing which is fittable on the first casing and is adapted to retain main wires such that the main wires face corresponding second blade portions, the first blade portions having in particular a lower height than the second blade portions.

Preferably, the terminal is formed by forming slits in the opposite ends of a strip from front end portions thereof and bending at least once the opposite ends substantially at an angle, in particular at a right angle in the same direction by different lengths or by forming two or more slits on portions of a strip from the lateral side thereof and bending the strip at an angle along a direction substantially in parallel to the slits, the slits having a different length and/or the side portions of the strips being stepped, wherein particularly the blade portions particularly of different heights are displaced in a lateral direction while facing parallel to each other.

Still further preferably, the blade portions are obliquely arranged in the housing.

According to a most preferred embodiment, the height difference of the blade portions is substantially equal to or greater than the thickness of the wires.

According to a preferred embodiment of the invention, there is provided a cramping connector, comprising:

a terminal comprising a plurality of blade portions of different heights which extend in the same direction, and a housing for accommodating and retaining the terminal such that wires are pressed to be connected with the blade portions.

Accordingly, the plurality of blade portions extending in the same direction are so arranged as to have different heights in the terminal. Wires can be pressed to be connected with the blade portions having different heights when the terminal is accommodated in the housing. Accordingly, the connected wires can be arranged at different heights.

As described above, since the plurality of blade portions having different heights are provided, the wires can be arranged at different heights, thereby improving a degree of freedom. In this case, the width of the cramping terminal can be narrowed if the wires are arranged in two stages.

According to a further embodiment of the invention, there is provided a cramping connector, comprising:

a housing for retaining a main wire and a branch wire branched from the main wire in its intermediate position one over the other, and a terminal which comprises a blade portion for the upper wire and another blade portion for the lower wire, the blade portions having different heights and being aligned along the longitudinal direction of the wires, and is accommodated in the housing such that the main and branch wires are pressed to be connected with the blade portions thereof.

Accordingly, the housing retains the main wire and the branch wire branched from the main wire in its intermediate position one over the other. When the main wire is inserted, while the end of the branch wire is inserted into the housing, through the housing over the branch wire, the main wire is placed on the branch wire in the housing. The terminal is accommodated in the housing, and the branch wire is pressed to be connected with the blade portion for the lower wire and the main wire is pressed to be connected with the blade portion for the upper wire in its position where it is not placed on the branch wire. In other words, a single terminal connected with the main wire and the branch wire placed one over the other. If such terminals are arranged side by side, the wires can be arranged in two vertical stages.

Thus, since the main wire and the branch wires are connected, placed one over the other, the height of the cramping connector can be made smaller.

Further preferably, the housing comprises:

a lower casing formed with a wire path extending in a lateral direction and an opening in an upward direction for accommodating the terminal such that the blade portions extend in the upward direction, and retaining the lower wire placed on the blade portion therefor, and an upper casing for closing the opening of the lower casing and retaining the upper wire such that the upper wire faces the blade portion therefor when the upper casing closes the opening of the lower casing.

Accordingly, the lower casing constructing the housing comprises the wire path extending in the lateral direction and is open in the upward direction, and the terminal is accommodated such that the blade portions extend in the upward direction. The branch wire as the lower wire is placed and retained on the blade portion for the lower wire. On the other hand, the upper casing constructing the housing is capable of retaining the main wire as the upper wire. When the upper casing closes the opening of the lower casing while retaining the main wire, the main wire faces the blade portion for the upper wire of the terminal in the lower casing and the branch wire faces the blade portion for the lower wire. By pressing the upper and lower casings, the wires are connected with the corresponding blade portions.

Thus, the connection can be made only by fitting the lower casing and the upper casing retaining the branch wire and the main wire together, making an operation easier.

According to a further preferred embodiment of the invention, there is provided a cramping connector, comprising:

a plurality of terminals each having a plurality of blade portions of different heights which are so arranged as to cross the longitudinal directions of wires to be connected therewith, a first casing comprising an open surface and grooves for accommodating wires to be connected with the blade portions of the same height in the plurality of terminals in parallel with each other, the grooves intersecting with grooves for wires to be connected with the blade portions of the other heights in a manner similar to that of a network and the terminals being mounted at the intersections of the grooves, and a second casing for covering the open surface of the first casing, the second casing comprising wire pressing portions which come into contact with the wires so as to press the wires into the blade portions.

Accordingly, in the first casing having the open surface, the substantially parallel grooves for accommodating the wires to be connected are formed in a manner similar to that of a network. The wires are pressed into these grooves through the open surface to be accommodated therein. On the other hand, the terminals each having a plurality of blade portions of the heights which are changed or varied particularly with respect to or along the longitudinal directions of the wire(s) are mounted at the intersections of the grooves. Accordingly, the wires can be connected at the intersections. When the second casing is fitted to the first casing after the wires are accommodated in the first casing, the wire pressing portions come into contact with the wires so as to press them into the blade portions, thereby facilitating the connection by the blade portions in the terminals and holding the wires.

As described above, since the substantially parallel grooves are formed for each group of wires to be connected, the plurality of wires are so accommodated in one casing as to intersect in the manner similar to the network. Further, non-intersecting portions of the wires are held by being pressed by the other casing. Accordingly, there can be provided a cramping connector which allows the wires to be arranged through one open surface, thereby improving an operability.

In other words, there is provided a cramping connector which ensures a compact wire arrangement.

Preferably, each terminal is formed by bending a metal strip in V-shape so as to form surfaces perpendicular to the longitudinal directions of the wires to be connected and making a slit in each surface from an edge.

Accordingly, the metal strip is so bent a number of times corresponding to the number of the wires to be connected, thereby forming a plurality of surfaces perpendicular to the longitudinal directions of the wires. Further, the slit is formed in each surface from the edge. The terminals are connected with the intersecting wires at the intersections of the grooves in the first casing.

Thus, the terminals can be easily formed only by bending the strips.

Further preferably, the edge of each terminal where the slits are formed has a steplike contour.

Accordingly, since the edge of each terminal where the slits are formed has a steplike contour, if the slits of the same depth are formed, the blade portions of different heights can be formed in the respective surfaces.

Thus, since the edge has a steplike contour, the respective blade portions are easily distinguishable and the heights thereof are easily adjustable.

Still further preferably, a metal strip is bent in two at right angles and wherein the first and second casings are formed with two groups of grooves perpendicularly intersecting with each other in a manner similar to that of a checkerboard.

Accordingly, the first and second casings are formed with two groups of grooves intersecting with each other in a manner similar to that of a checkerboard, and the terminals each formed by bending a metal strip in two at right angles to form blade portions perpendicular to each other are mounted at the intersections where the wires intersect. Accordingly, the wires are connected with the blade portions and held by the casings by arranging and accommodating the wires in the grooves of the first casing in the manner similar to that of the checkerboard and by covering the first casing with the second casing.

Thus, since the grooves intersect at right angles in the manner similar to that of the checkerboard so as to correspond to two groups of wires, the construction can be simplified.

According to a further preferred embodiment of the invention, there is provided a cramping connector, comprising:

a plurality of terminals each having blade portions of different heights which are displaced with respect to forward and backward directions, a first casing for arranging and retaining the plurality of terminals side by side while orienting the terminals in the same direction, and retaining branch wires by placing ends thereof on the lower blade portions, and a second casing which is fittable on the first casing from above to form a single unit, is adapted to retain main wires such that the main wires face the corresponding higher blade portions, and is formed with such projections that face the corresponding lower blade portions between the main wires.

Accordingly, since the first casing retains the plurality of terminals by arranging them side by side while orienting them in the same direction, the lower and higher blade portions are arranged side by side with one in front of the other. When the branch wires are retained by the first casing and the main wires are retained by the second casing, the ends of the branch wires are placed on the lower blade portions of the terminals in the first casing and the main wires are retained on the projections in the second casing. When the first and second casings are fitted into a single unit, the main wires are pressed against the higher blade portions to be connected therewith, whereas the branch wires are pressed against the projections between the main wires to be connected with the lower blade portions.

As described above, since the main and branch wires are connected while being arranged in two vertical stages, the wire arrangement can be made more compact as compared with the case where the wires are arranged only side by side. Further, since the branch and main wires are connected with the blade portions of different heights between the casings, there can be provided a cramping connector capable of fully pressing the branch wires to securely connect them with the blade portions.

In other words there is provided a cramping connector having an improved wire arrangement operability.

Preferably, each terminal is formed by forming slits in the opposite ends of a strip from end portions thereof and bending the opposite ends substantially at right angles in the same direction by different lengths.

Accordingly, by forming the slits in the opposite ends of the strip from the end portions thereof and bending the opposite ends substantially at right angles in the same direction by different lengths, the terminal is allowed to have the blade portions formed with the slits of different heights at its upright sides.

Thus, the terminal can be easily formed only by bending the opposite ends of the strip in the same direction.

Further preferably, the blade portions of different heights are displaced in a lateral direction while facing parallel to each other.

Accordingly, since the blade portions of different heights are displaced in the lateral direction while facing parallel to each other, if the branch wires are connected at right angles with the lower blade portions and the main wires are connected at right angles with the higher blade portions, the branch and main wires are parallel to and displaced from each other when viewed from above.

Thus, since the blade portions of the terminal are displaced along the forward and backward directions and the lateral direction in advance, the respective wires can be arranged with respect to the axial direction of the casings, allowing the casings to have simpler constructions.

Still further preferably, the blade portions of different heights are obliquely arranged in the first casing.

Accordingly, since the blade portions of different heights are obliquely arranged in the first casing, if the branch and main wires are arranged parallel to each with respect to an axis relative to or basing on the first casing, they are parallel to and displaced from each other while being obliquely connected with the corresponding blade portions.

Thus, since the blade portions are displaced along the forward and backward directions and the lateral direction merely by obliquely arranging the terminals, the construction can be simplified.

According to a further preferred embodiment, there is provided a cramping connector, comprising:

a plurality of terminals having blade portions shifted along forward and backward directions, and a pair of casings for retaining the plurality of terminals along a lateral direction while orienting them in the same direction, such that ends of branch wires face the blade portions at one side and that main wires are inserted between the blade portions at the one side and face the blade portions at the other side, wherein the respective wires are pressed into slits formed in the corresponding blade portions when the pair of casings are assembled.

Accordingly, the terminals having the blade portions shifted along the forward and backward directions are arranged along the lateral direction while orienting them in the same direction, the branch wires face the blade portions at the one side, and the main wires face the blade portions at the other side and are inserted between the blade portions at the one side. More specifically, the branch and main wires are alternately arranged, and their positions of connection with the blade portions are alternately shifted substantially along the forward and backward directions substantially in a zigzag manner. Accordingly, as compared with the case where the positions of connection are arranged side by side in a row, the cramping connector can be narrower. Further, since the branch and main wires are pressed into the slits of the blade portions when the pair of casings are assembled, the assembling and the connection can be simultaneously performed.

Thus, when the main and branch wires are alternately arranged and connected with the corresponding blade portions, their positions of connection are alternately shifted along the forward and backward directions. Thus, the cramping connector can be narrower than the prior art connector in which the positions of connection are arranged side by side in a row.

Preferably, each terminal is formed by forming the slits at opposite ends of a strip and by bending the opposite ends substantially at right angles in the same direction.

Accordingly, each terminal has, at its opposite ends, two blade portions formed with a slit which are shifted along the forward and backward directions.

Thus, by bending the opposite ends of the strip in the same direction, the terminal having the blade portions shifted along the forward and backward directions can be easily formed.

Further preferably, the blade portions shifted along the forward and backward are opposed in parallel and shifted along a lateral direction.

Accordingly, if the branch wires are pressed at right angles against the front blade portions to be connected therewith and the main wires are pressed at right angles against the rear blade portions to be connected therewith, the branch and main wires are arranged in parallel when viewed from above and shifted to each other.

Thus, since the blade portions of the terminal are shifted along the forward and backward directions as well as along the lateral direction, the respective wires can be arranged with respect to the axis of the casings. Thus, the construction of the casings can be simplified.

Still further preferably, the terminals are obliquely arranged in the casings.

Accordingly if the branch and main wires are arranged in parallel with respect to an axis of the casings, the branch and main wires are shifted in parallel to each other while being obliquely connected with the corresponding blade portions.

Thus, by obliquely arranging the terminals, the blade portions can be shifted along the forward and backward directions as well as along the lateral direction, thereby simplifying the construction.

Most preferably, a surface of the casing which is to face a pressing device is so indented and embossed as to conform to a pressing surface of the pressing device.

Thus, this surface of the casing and the pressing surface of the pressing device are fitted to each other without experiencing any lateral displacement while the casings are pressed to be assembled.

Thus, since the pressing device and the casings are substantially engaged along a pressing direction, the casings can be securely pressed to be assembled without experiencing any lateral displacement.

BRIEF DESCRIPTION OF THE DRAWINGS

These and other objects, features and advantages of the present invention will become more apparent upon a reading of the following detailed description and accompanying drawings in which.

DETAILED DESCRIPTION OF THE PREFERRED EMBODIMENTS

Figure 1:
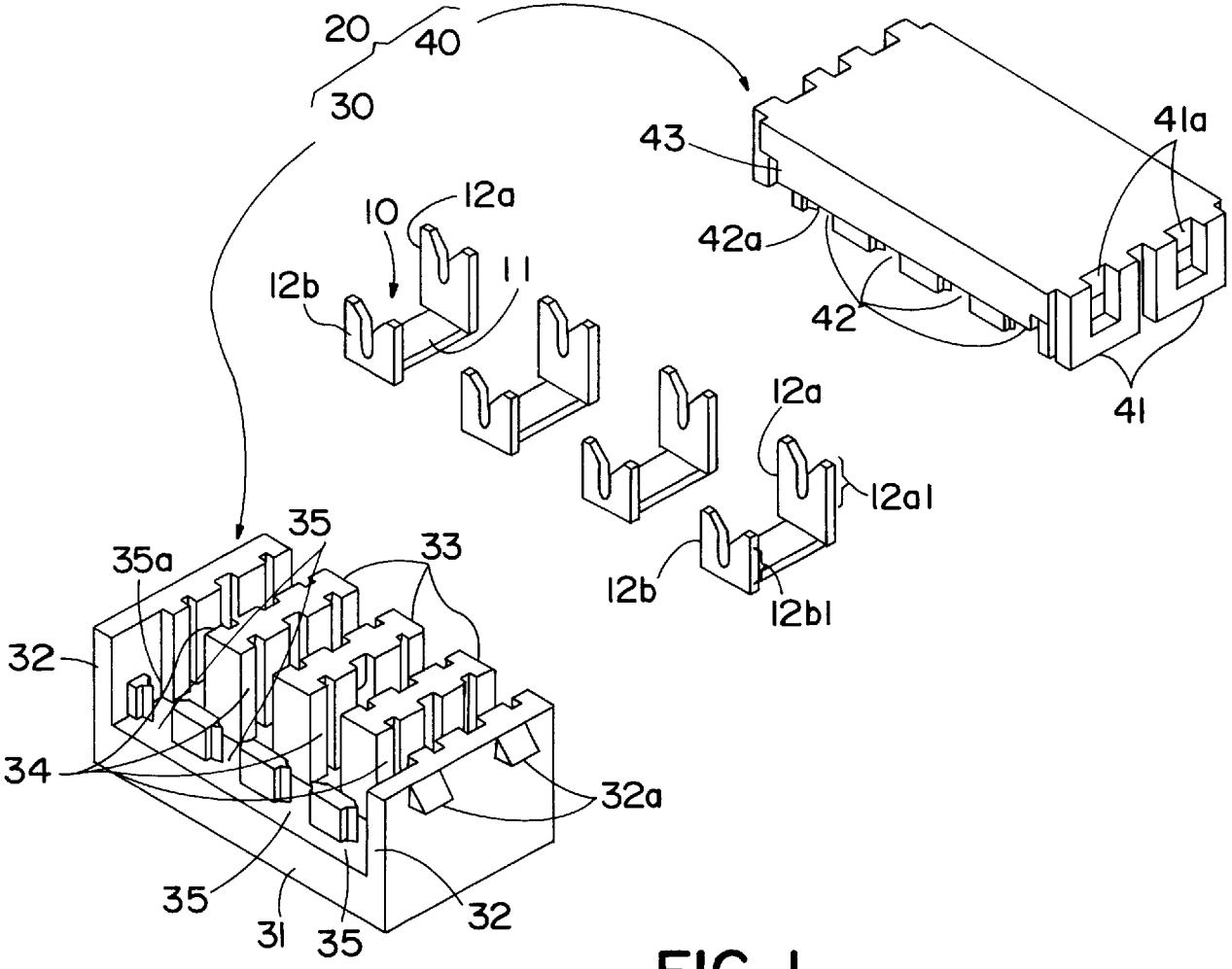
FIG. 1 is an exploded perspective view of a cramping connector according to a first embodiment of the invention.

In FIG. 1, each terminal 10 is formed by making slits at the opposite ends of a strip 11 to form blade portions or blade carrying parts 12*a*, 12*b* having (or including or carrying) blade portions 12*a*1, 12*b*1 and by bending the blade parts 12*a*, 12*b* such that the terminal 10 has a substantially U-shaped cross section. The blade portions 12*a*, 12*b* are formed such that the rear blade part 12*a* and/or the rear blade portion 12*a*1 is higher than the front blade part 12*b* and/or the front rear portion 12*b*1, i.e. the blade parts 12*a*, 12*b* and/or blade portions 12*a*1, 12*b*1 have different heights.

In this embodiment, the terminal 10 is formed by bending the opposite ends of the strip 11 by different lengths. Since it is sufficient to at least differ the heights of a plurality of blade parts 12*a*, 12*b* and/or of blade portions 12*a*1, 12*b*1, the opposite ends of the strip 11 may be bent at different angles. However, in the case that the opposite ends of the strip 11 are bent in the same direction such that the slits are aligned as in this embodiment, when being pressed into the slits to be connected, two wires are placed one over another, realizing a compact arrangement.

In this embodiment, each terminal 10 is formed such that two wires are arranged one over another to be connected, and a housing 20 is so formed as to arrange wires in two vertical stages.

The housing 20 for accommodating the terminals 10 includes a box-shaped lower casing 30 and an upper casing 40 for closing an opening in the upper surface of the lower casing 30.

Figure 2:
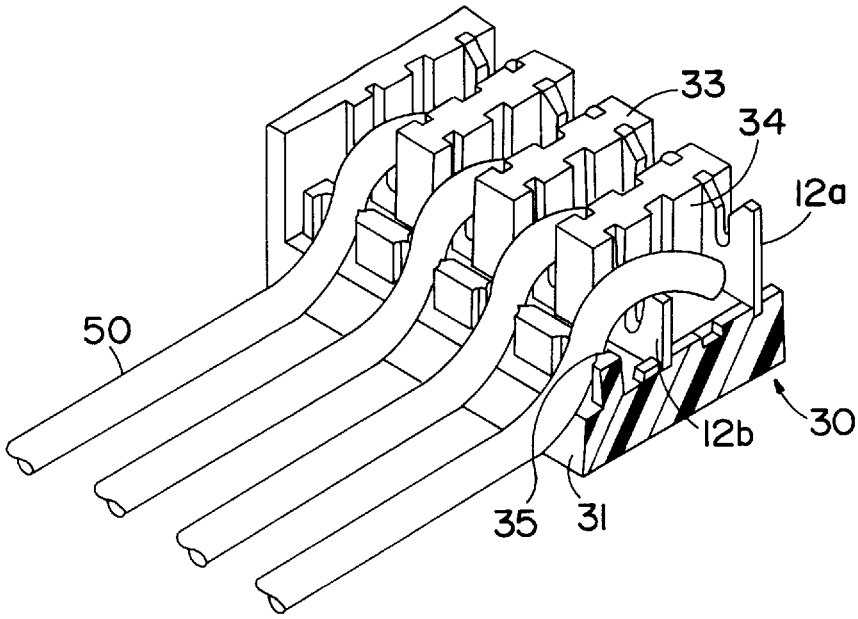
FIG. 2 is a perspective view partly in section of a partly assembled state of a lower casing of the cramping connector.

As shown in FIG. 1 or 2, the lower casing 30 has a bottom wall 31, left and right side walls 32. The front, rear and ceiling surfaces of the lower casing 30 are open in lateral and vertical directions. Three partition walls 33 are so formed as to define clearances corresponding to the width of the terminals 10. A total of four terminal chambers 34 are formed by the three partition walls 33 formed by the left and right side walls 32. The respective terminals 10 are accommodated in the four terminal chambers 34 such that the lower blade parts 12*a* and/or the lower blade portions 12*a*1 and the higher blade parts 12*b* and/or the higher blade portions 12*b*1 are located at the front and at the back, respectively and that the slits of the blade portions 12*a*, 12*b* are open upward. Each terminal 10 is fixed by fitting the opposite ends of the blade portions 12*a*, 12*b* into grooves formed at or in proximity of the opposite side walls of the corresponding terminal chamber 34.

Wire retaining grooves 35 are formed on the bottom wall 31 by projections before and in conformity with the four terminal chambers 34. Linearly extending projections 35*a* are formed on the inner wall surfaces of the wire retaining grooves 35. The projections 35*a* cut in the insulation coatings of the wires so as to prevent the wires from coming out of the grooves 35. The grooves 35 and the lower blade portions 12*b* of the terminals 10 are at substantially the same height so that, when branch wires 50 are retained in the grooves 35, the leading ends of the branch wires 50 are pressed to be connected with the blade parts 12*b* and/or the blade portions 12*b*1 and linearly extend. The slits of the higher blade parts 12*a* and/or the higher blade portions 12*a*1 are located higher than those of the lower blade parts 12*b* and/or the lower blade portions 12*b*1 by about the thickness or diameter of one wire or more.

Locking projections 32*a* are formed at the upper ends of the outer surfaces of the left and right side walls 32. The upper casing 40 for closing the opening in the upper surface of the lower casing 30 is formed with locking arms 41 for holding the upper ends of the left and right side walls 32. The locking arms 41 are formed with lock holes 41a engageable with the locking projections 32*a*. Two each of the locking projections 32*a*, the locking arms 41 and the lock holes 41*a* are arranged one in front of the other at the left and right side walls 32.

Figure 3:
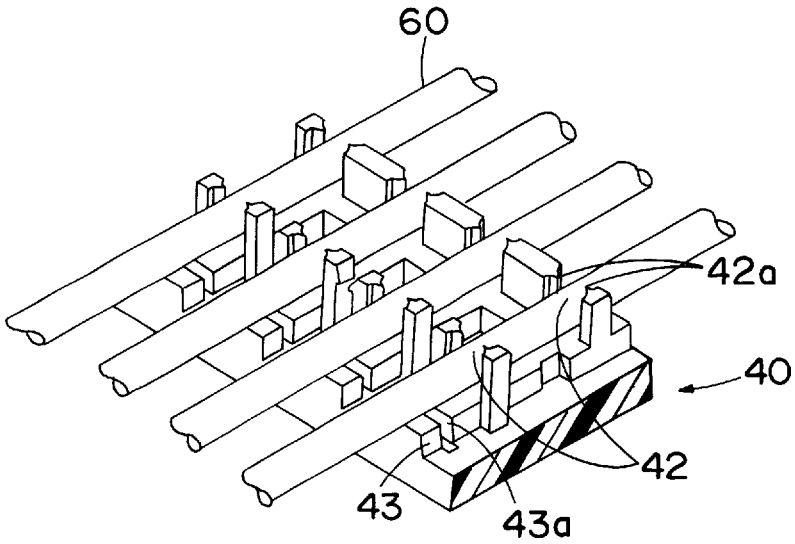
FIG. 3 is a perspective view partly in section of a partly assembled state of an upper casing of the cramping connector.

As shown in FIG. 3, similar to the wire retaining grooves 35, four wire retaining grooves 42 are formed by projections on the inner surface of the upper casing 40 to be opposed to the lower casing 30. On the inner surfaces of the respective wire retaining grooves 42, there are also formed linearly extending projections 42*a* for cutting in the insulation coatings of the wires to prevent them from coming out of the grooves 42. For each wire, two wire retaining grooves 42 are formed at the front and rear sides. When the upper casing 40 closes the opening of the lower casing 30 while retaining main wires 60, the main wires 60 are in positions to be pressed against the higher blade parts 12*a* and/or the higher blade portions 12*a*1. The wire retaining grooves 42 are formed on particularly pillow-shaped stepped portions 43 which are slightly higher than the inner surface of the upper casing 40 so that the wires 60 can be easily pressed toward the lower casing 30. Each stepped portion 43 is formed with a laterally extending slit 43*a* into which the upper end of the blade part 12*a* and/or the blade portion 12*a*1 is substantially fittable. By fitting the upper ends of the blade parts 12*a* and/or the blade portions 12*a*1 into the slits 43*a*, the wires on the stepped portions 43 can be more easily pressed into the slits of the blade parts 12*a* and/or of the blade portions 12*a*1.

Although the housing 20 is constructed by the lower casing 30 and the upper casing 40 in this embodiment, any housing may be used provided it can accommodate the terminals 10 having the blade parts 12*a*, 12*b* and/or the blade portions 12*a*1, 12*b*1 of different heights (or depths) or arranged at different heights and retain the wires 60, 50 such that they can be connected with the corresponding blade parts 12*a*, 12*b* and/or blade portions 12*a*1, 12*b*1. For example, a casing which can be opened and closed may be integrally formed, or the upper surface may be open. However, if the branch wires 50 and the main wires 60 are retained in specified positions of the lower casing 30 and the upper casing 40 which can be opened and closed, and the casings 30, 40 are fitted to press the wires 50, 60 against the blade parts 12*a*, 12*b* and/or the blade portions 12*a*1, 12*b*1 as in this embodiment, operability can be improved.

Further, the wire retaining grooves 35, 42 may be suitably modified provided they can retain the wires in the specified positions. If the wire retaining grooves are arranged in a manner similar to that of a crankshaft instead of being linearly arranged, the wires can securely stay therein. Further, if the wire retaining grooves are arranged such that the wires are bent in a three-dimensional manner, the wires can more securely stay therein. In this embodiment, the branch wires 50 and the main wires 60 are arranged one over the other, and the branch wires 50 are pressed against the blade portions 12*b* by the main wires 60. Accordingly, a force to press the wires 50 against the blade parts 12*b* and/or the blade portions 12*b*1 is slightly taken up. The above ensures a compact arrangement. However, if the upper located main wires 60 are slightly curved with respect to a horizontal direction so as to project toward the branch wires 50, the projected portions of the main wires 60 press the branch wires 50 against the blade parts 12*b* and/or the blade portions 12*b*1, with the result that a loss of the pressing force can be made smaller.

Figure 4:
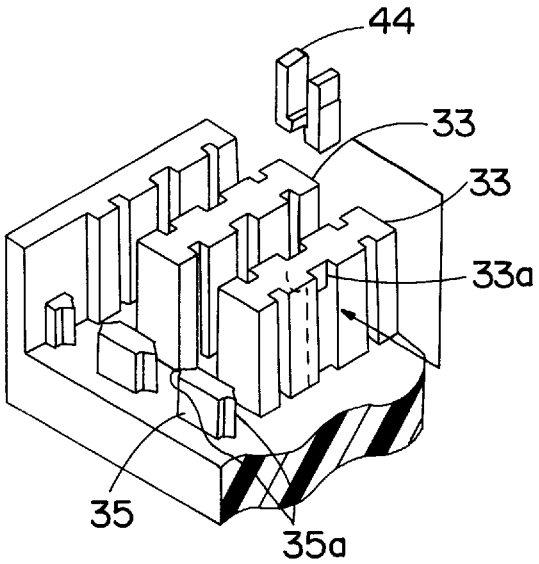
FIG. 4 is a perspective view partly in section partly showing lower and upper casings of a cramping connector according to a second embodiment.

Further in this embodiment, the lower and upper casings 30 and 40 are locked by the locking projections 32*a* and the locking arm 41 on the left and right sides. If a recess 33*a* is formed substantially in the middle of the upper end of one partition wall 33 of the lower casing 30 and a pair of cover locks 44 engageable with the recess 33*a* are formed on the inner surface of the upper casing 40 as shown in FIG. 4, the upper and lower casings 30, 40 are locked not only at the opposite sides, but also in the middle, making themselves more unlikely to be detached.

Next, how the embodiment thus constructed operates is described.

The terminals 10 are accommodated in the corresponding terminal chambers 34 of the lower casing 30. As shown in FIG. 2, the leading end of the branch wire 50 is placed on the blade part 12*b* and/or the blade portion 12*b*1 held in the terminal chamber 34, and the branch wire 50 is pressed into the wire retaining groove 35. The projection 35*a* formed on the inner surfaces of the wire retaining groove 35 cut in or deforms the insulation coating of the branch wire 50 and retain the branch wire 50 when the branch wire 50 is pressed into the groove 35. The branch wires 50 are similarly set for the respective terminals 10.

On the other hand, the main wire 60 is pressed into the wire retaining groove 42 in the upper casing 40. The projections 42*a* of the wire retaining grooves 42 cut in or deform the insulation coating of the main wire 60 in at least two positions at the front and rear sides, with the result that the main wire 60 is retained by the upper casing 40. E.g. four main wires 60 are retained in a similar manner.

Figure 5:
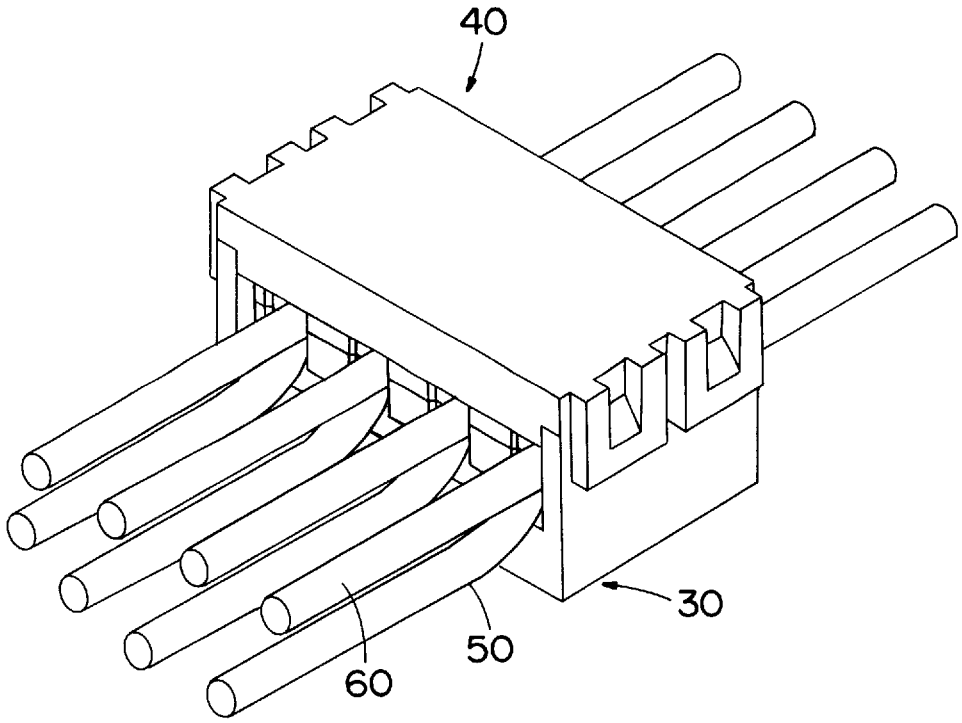
FIG. 5 is a perspective view of a completely assembled cramping terminal.
Figure 6:
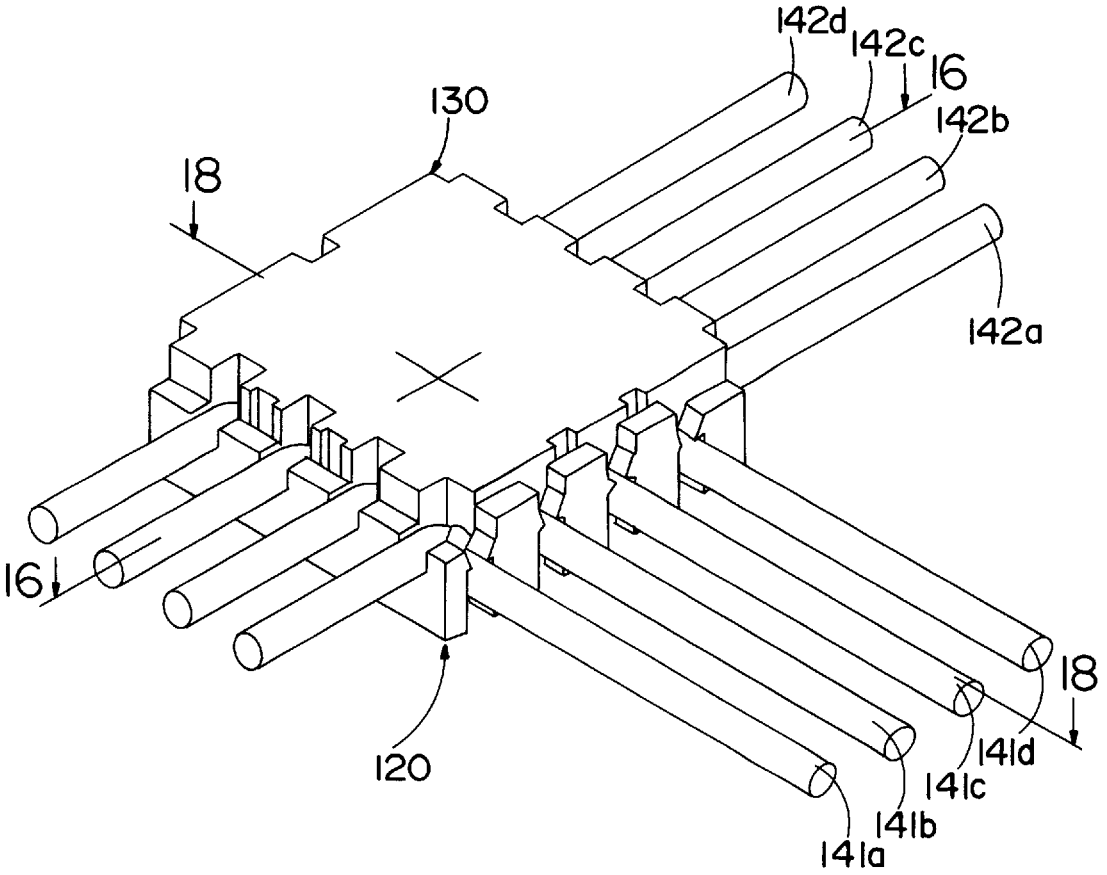
FIG. 6 is a perspective view of a cramping connector according to a third embodiment of the invention in its assembled state.
Figure 7:
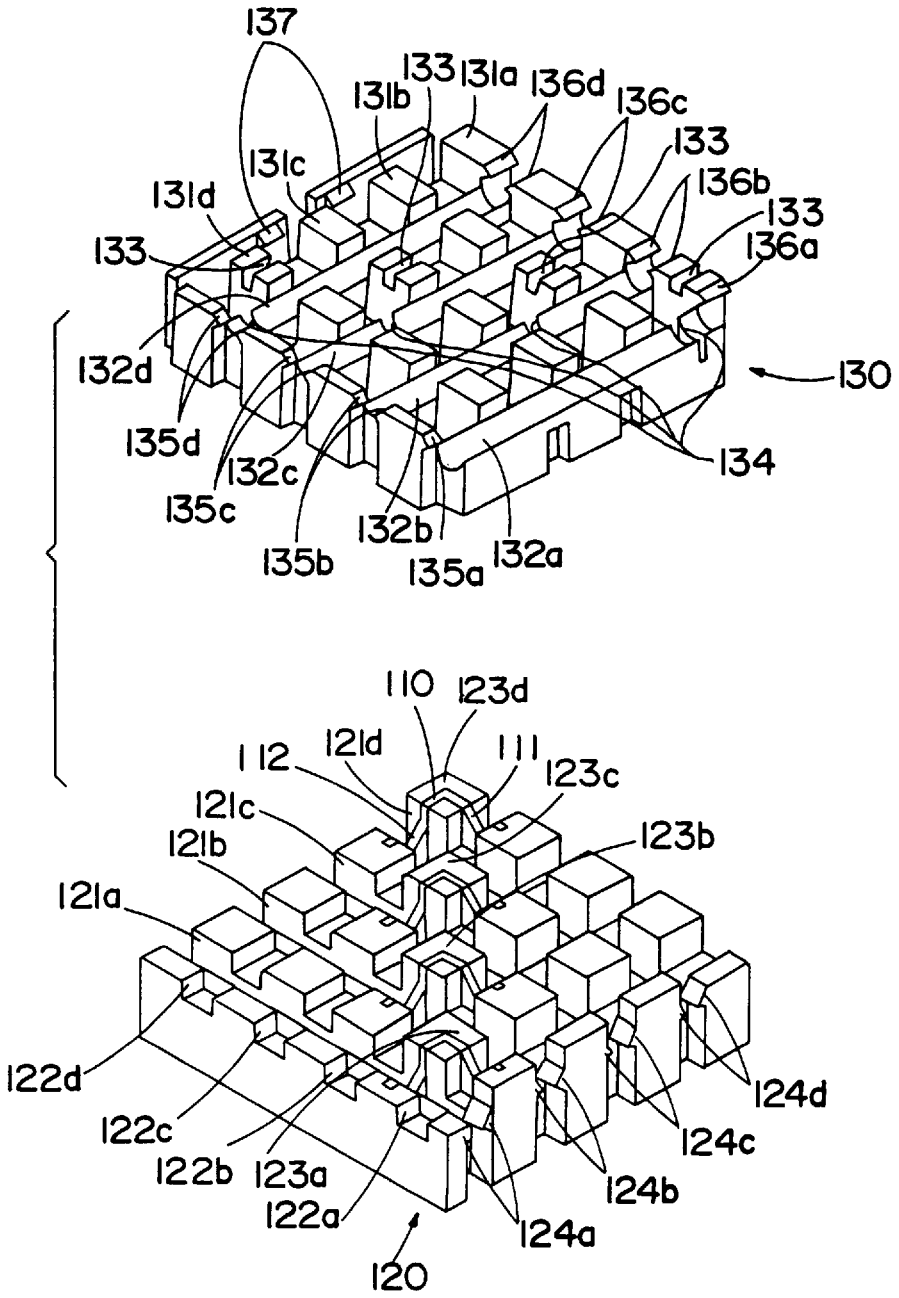
FIG. 7 is an exploded perspective view of the cramping connector.
Figure 8:
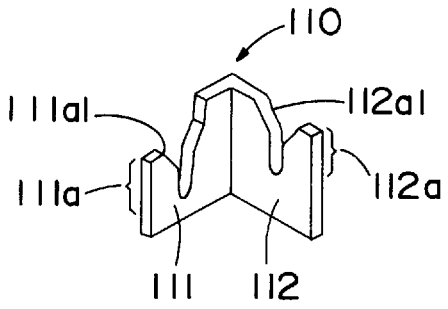
FIGS. 8 and 9 are perspective views of a terminal of the cramping connector.
Figure 9:
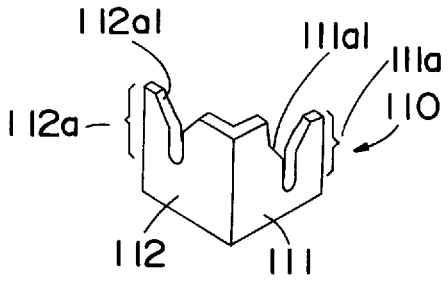

Thereafter, the upper casing 40 is so fitted as to close the opening in the upper surface of the lower casing 30. At this time, the main wires 60 retained by the upper casing 40 are pressed against the blade parts 12*a* and/or against the blade portions 12*a*1 of the terminals 10 held in the lower casing 30 and are also pressed against the branch wires 50 placed on the blade parts 12*b* and/or the blade portions 12*b*1. When the upper casing 40 is further pressed, the main wires 60 are pressed into the slits of the blade parts 12*a* and/or the blade portions 12*a*1 to be connected therewith, and the branch wires 50 are pressed into the slits of the blade parts 12*b* and/or the blade portions 12*b*1 via the main wires 60 to be connected therewith. As shown in FIG. 5, four each of the branch wires 50 and the main wires 60 are arranged in two vertical stages. As a whole, the wires are accommodated in a very compact manner.

As described above, the terminals 10 are each formed such that two blade parts 12*a*, 12*b* and/or blade portions 12*a*1, 12*b*1 of different heights are aligned with respect to the longitudinal direction of the wires to be connected by bending the opposite ends of the strip 11 in the same direction by different lengths. In the lower casing 30 for accommodating the terminals 10, the branch wires 50 are placed on the lower blade parts 12*b* and/or on the lower blade portions 12*b*1. The upper casing 40 for covering the lower casing 30 retains the main wires 60 such that the main wires 60 face the lower blade part 12*a* and/or the lower blade portions 12*a*1 when the lower casing 30 is covered by the upper casing 40. When the upper casing 40 is fitted on the lower casing 30, the main wires 60 held by the upper casing 40 are pressed into the slits of the blade parts 12*a* and/or the blade portions 12*a*1 to be connected therewith, and press the branch wires 50 placed on the blade parts 12*b* and/or the blade portions 12*b*1 in the lower casing 30 into the slits of the blade parts 12*b* and/or the blade portions 12*b*1 so that the branch wires 50 are connected with the blade parts 12*b* and/or the blade portions 12*b*1. The connected wires 50, 60 are arranged in two vertical stages in a compact manner.

In FIGS. 6 to 9, a terminal 110 is formed by bending a metal strip at a substantially right angle so as to have two surfaces perpendicular to each other. The respective surfaces are cut at a right angle from one longer edge of the terminal 110 to form slits 111*a*1, 112*a*1. These surfaces formed with slits 111*a*1, 112*a*1 act as blade parts 111, 112 and/or as blade portions 111*a*, 112*a*, wherein the blade parts 111, 112 comprise or include or carry the blade portions 111*a*, 112*a*. The edge of the terminal 110 where the slits 111*a*1, 112*a*1 are formed already has a steplike contour before the terminal 110 is bent. By forming the slits 111*a*1, 112*a*1 of the same depth, the blade parts 111, 112 and/or the blade portions 111*a*, 112*a* having different heights are formed.

Although the terminal 110 has the two blade parts 111, 112 formed by bending the metal strip at right angles in this embodiment, it is sufficient to make the longitudinal directions of wires to be connected intersect. The number of blade portions and/or blade parts may be increased as in a terminal shown in FIGS. 10 and 11 which has three blade portions and/or blade parts arranged such that neighboring blade portions are at an angle of substantially 45°. Further, although the edge of terminal 110 where the slits 111*a*1, 112*a*1 are formed has a steplike contour in this embodiment, a parallelogrammatical or trapezoidal strip may be bent such that two smaller parallelogrammatical pieces intersect at different heights and the slits 111*a*1, 112*a*1 may be formed in the upper edges thereof. By having a steplike contour, the respective blade parts 111, 112 and/or blade portions 111*a*, 112*a* can be more clearly distinguished, and the wires can be more easily crossed. The shape of the slits formed in the blade parts 111, 112 and/or the blade portions 111*a*, 112*a* is not particularly specified, but may be suitably changed according to the kind of a wire core, i.e. whether the core is made of a single wire or a plurality of wires.

In this embodiment, by using the metal strip having a steplike contour and forming the slits of the same depth, the blade parts 111, 112 and/or the blade portions 111*a*, 112*a* that appear to have different heights are formed. However, deep slits may be formed in the strip and the height of the actually used portion of the blade part and/or the blade portion may be changed by changing the depth by which the wire is pressed.

A housing 120 as a first casing has a substantially square flat shape, and four each of first grooves 121 (121*a* to 121*d*) and second grooves 122 (122*a* to 122*d*) which intersect at right angles as in a checkerboard are formed in the upper surface of the housing 120. The first grooves 121*a* to 121*d* are continuous grooves crossing the housing 120 substantially in parallel. The second grooves 122*a* to 122*d* also cross the housing 120, but the bottom surfaces thereof are located higher than those of the first grooves 121*a* to 121*d*. Accordingly, the second grooves 122*a* to 122*d* are interrupted or crossed by the first grooves 121*a* to 121*d*.

Figure 13:
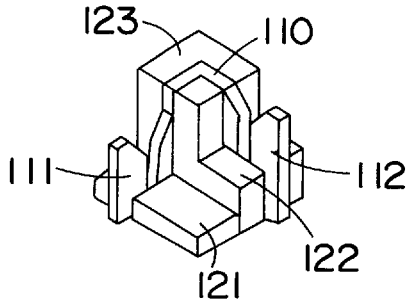
FIG. 13 is a fragmentary enlarged perspective view of the mounted terminal.

The first grooves 121*a* to 121*d* and the second grooves 122*a* to 122*d* intersect in 16 positions arranged in a manner similar to that of a 4×4 matrix. The terminals 110 are mounted at intersections preferably along one diagonal line. Specifically, the terminals 110 are pressed into rectangular walls 123*a* to 123*d* projecting from portions of the housing 120 other than the grooves 121, 122 such that the lower blade parts 111 and/or the lower blade portions 111*a* of the terminals 110 cross the first grooves 121 at substantially right angles and the higher blade parts 112 and/or the higher blade portions 112*a* cross the second grooves 122 at substantially right angles. How the terminal 110 is mounted is enlargedly shown in FIG. 13.

Figure 10:
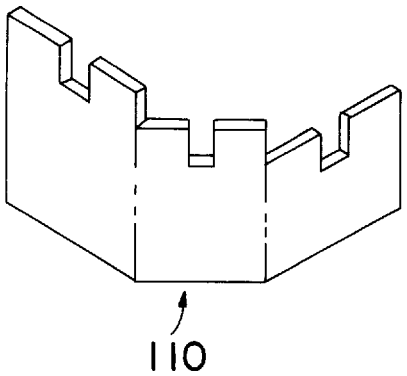
FIGS. 10 and 11 are perspective and plan views of a terminal according to a fourth embodiment, respectively.
Figure 11:
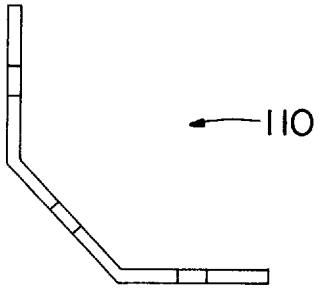
Figure 12:
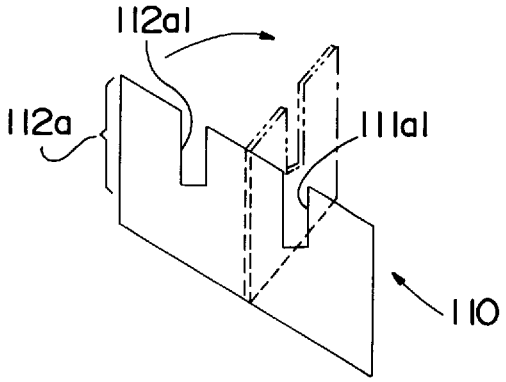
FIG. 12 is a development of a terminal according to a fifth embodiment.
Figure 14:
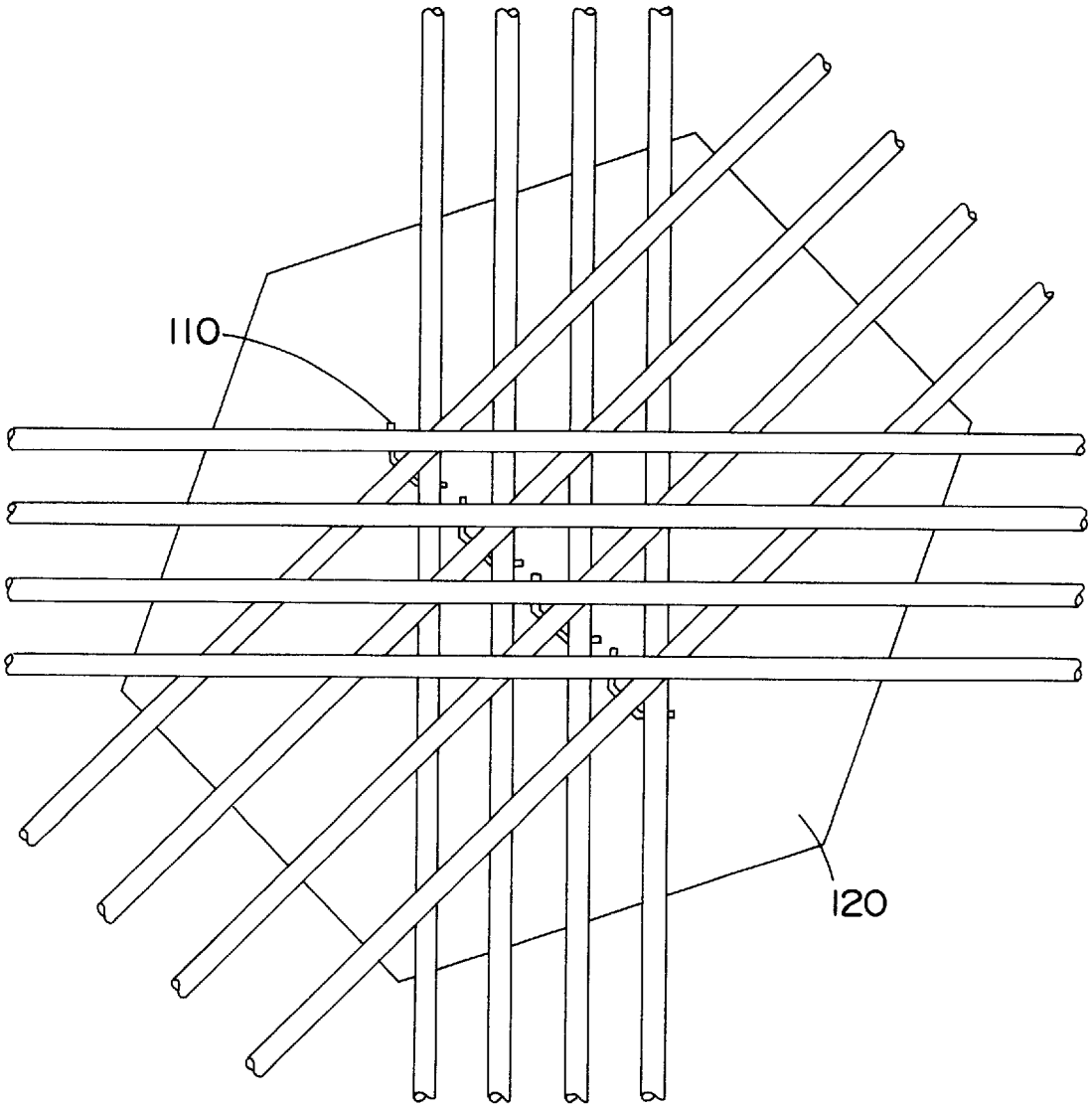
FIG. 14 is a schematic plan view of a housing a according to a sixth embodiment.
Figure 15:
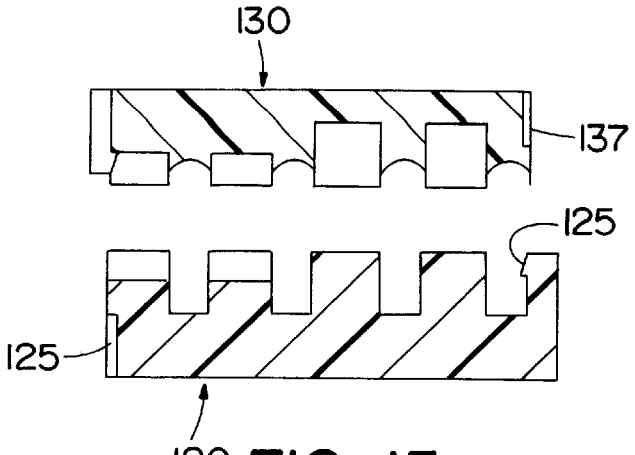
FIGS. 15 and 16 are sections along 16—16 of a housing and a cover of FIG. 6.
Figure 16:
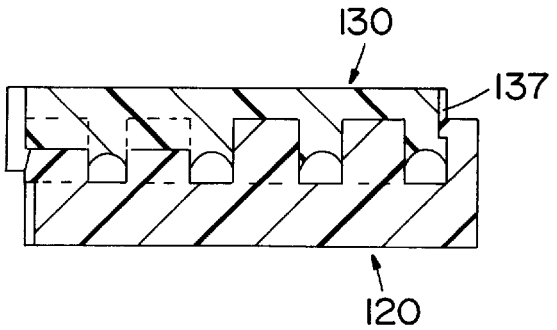
Figure 17:
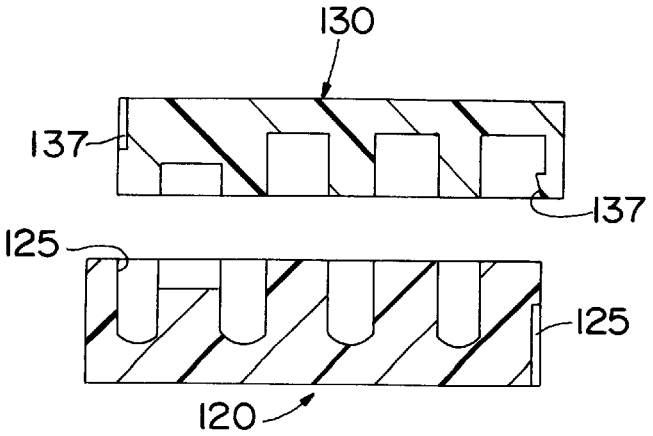
FIGS. 17 and 18 are sections along 18—18 of the housing and the cover of FIG. 6.
Figure 18:
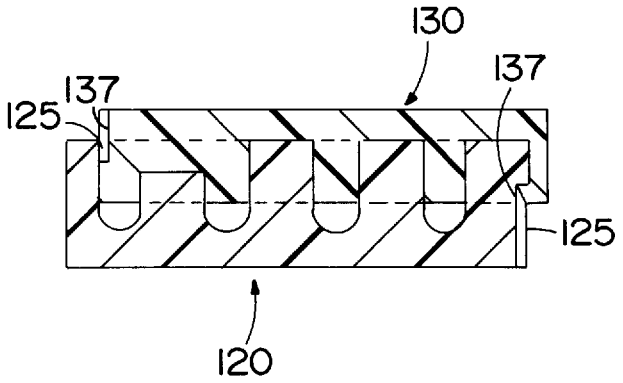

In this embodiment, two groups of first grooves 121 (121*a* to 121*d*) and second grooves 122 (122*a* to 122*d*) intersecting at right angles are formed. However, the invention is not limited to this arrangement of grooves, but more groups of grooves may be formed provided they intersect in a manner similar to that of a network. For example, terminals having three blade parts and/or blade portions as shown in FIGS. 10 and 11 may be used together with a substantially hexagonal shaped housing formed with three groups of grooves as shown in FIG. 14.

Further in this embodiment, the terminals 110 are mounted at those of the intersections arranged like a matrix which are located along one diagonal line. The terminals 110 may not necessarily be located on the diagonal line, but may be selectively mounted at other intersections.

Although the depth of the first grooves 121*a* to 121*d* and the depth of the second grooves 122*a* to 122*d* are differed so that the wires can be arranged in a three-dimensional manner or on different planes in the embodiment, the depth of the grooves may need not necessarily be changed. However, by changing the depth of the grooves according to the wires to be intersected at the terminals 110, an operator can easily see wire arrangement positions and an upward or downward displacement of the wires during the arrangement can be prevented. Further, by forming wavy grooves instead of the linear grooves 121, 122, the wires can more securely stay in the grooves.

In this embodiment, wedge-shaped projections 124*a* to 124*d* which project more as they extend more downward or which taper downwards are formed at the opposite edges of the openings of the grooves 121*a* to 121*d* at one side so as to prevent the wires from easily coming out of the grooves 121*a* to 121*d*.

A cover 130 is adapted to cover an open upper surface of the housing 120 and is formed with linearly extending first projections 131 (131*a* to 131*d*) and second projections 132 (132*a* to 132*d*) in conformity with the first grooves 121*a* to 121*d* and the second grooves 122*a* to 122*d*, respectively. The second projections 132 substantially continuously extend, but the first projections 131 are interrupted or crossed by the lower first projections 131 so as to be pressed while straddling the crossing wires. Accordingly, the wires can be held on the second projections 132 while being tightly held between the interrupted portions of the first projections 131. Since the first projections 131*a* to 131*d* and the second projections 132*a* to 132*d* face the wires to be connected, portions thereof face the blade parts 111, 112 and/or the blade portions 111*a*, 112*a* of the terminals 110. In such portions of the first and second projections 131, 132, slots 133, 134 corresponding to the thickness of the terminals 110 are formed. Accordingly, when the cover 130 is fitted on the housing 120, the blade parts 111, 112 and/or the blade portions 111*a*, 112*a* of the terminals 110 are fitted into the slots 133, 134 and the wires are pressed downward at the opposite sides of the blade parts 111, 112 and/or blade portions 111*a*, 112*a*. Front and rear walls of the slots 133, 134 act as wire pressing portions in this embodiment.

Although the cover 130 has a substantially square shape so as to correspond to the housing 120 in this embodiment, the shape thereof can be suitably changed according to the shape of the housing 120 in the case that the housing 120 is modified as described above. Further, although the linearly extending first and second projections 131, 132 are formed in conformity with the first and second grooves 121, 122 in order to more easily press the wires in this embodiment, ribs or struts may be formed in positions to project from the cover 130 to press the wires. Further, the wire pressing portions do not have to be slots 133, 134 into which the blade parts 111, 112 and/or the blade portions 111*a*, 112*a* are fittable, but can be anything provided they can come into contact with the wires before and after the blade parts 111, 112 and/or the blade portions 111*a*, 112*a* and press them.

In this embodiment, wedge-shaped projections 135*a* to 135*d*, 136*a* to 136*d* which project more as they extend more downward or which taper downwards are formed at the opposite edges of the openings of the projections 132 at both sides so that the wires securely stay on the projections 132.

The housing 120 and the cover 130 are formed with recesses and projections 125, 137 on their surfaces which come into sliding contact with each other when the housing 120 and the cover 130 are fitted, and can be locked by engaging the recesses and projections 125, 137 (see FIGS. 15 to 18).

Next, how the embodiment thus constructed operates is described.

The housing 120 is placed such that the grooves 121, 122 are found in the upper surface thereof, and branch wires 141*a* to 141*d* to be connected are pressed into the first grooves 121. The cover 130 is placed such that the projections 131, 132 are found in the upper surface thereof, and main wires 142*a* to 142*d* to be connected are held on the second projections 132*a* to 132*d*. Since the terminals 110 are mounted at the intersections of the grooves 121, 122 in the housing 120, each branch wire 141 crosses the blade part 111 and/or the blade portion 111*a* of one terminal 110 when being pressed into the groove 121. The branch wires 141 are merely so placed as to cross the blade parts 111 and/or the blade portions 111*a* without being pressed into the slits 111*a* of the blade parts 111, and are locked in the grooves 121 by the projections 124*a* to 124*d* at the openings at one side so as not to be displaced. In the cover 130, the main wires 142*a* to 142*d* are locked by the projections 135*a* to 135*d*, 136*a* to 136*d* at the openings at both sides so as not to fall down even when the cover 130 is turned upside down.

Figure 19:
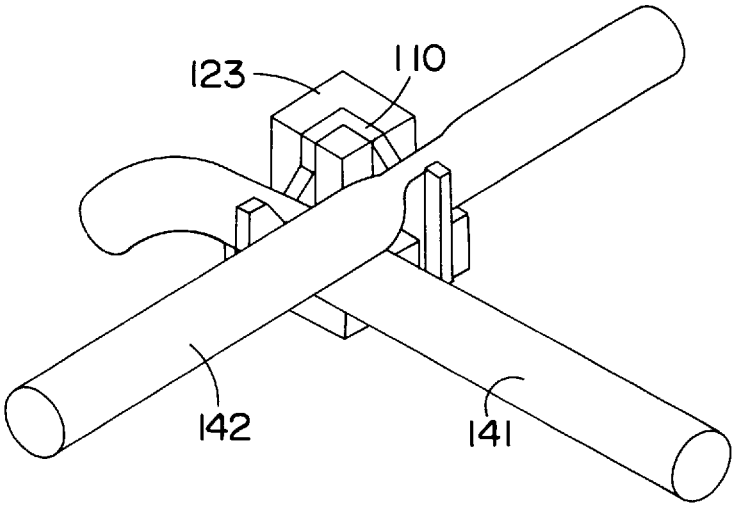
FIG. 19 is a fragmentary perspective view of a connection at the terminal.

After e.g. four each of the branch wires 141 and the main wires 142 are accommodated in the housing 120 and the cover 130, respectively, the cover 130 is turned upside down and fitted on the upper surface of the housing 120. Then, the second projections 132*a* to 132*d* face and press the main wires 142 into the second grooves 122, and the first projections 131*a* to 131*d* face and press the lower located branch wires 141 into the first grooves 121 while straddling the main wires 142. Further, the slots 133, 134 formed in the projections 131, 132 press the branch and main wires 141, 142 crossing over the blade parts 111, 112 and/or the blade portions 111*a*, 112*a* particularly in a curved manner into the slits 111*a*, 112*a* of the blade parts 111, 112 and/or the blade portions 111*a*, 112*a* so as to connect the wires 141, 142 with the blade parts 111, 112 and/or the blade portions 111*a*, 112*a*, respectively. When the cover 130 is fully fitted on the housing 120, the cover 130 and the housing 120 are locked by engagement of the projections and recesses 137, 125 and the connected wires are tightly held by the wedge-shaped projections 124, 135, 136 so as not to come out. FIG. 19 shows how the wires are connected with the terminal 110.

Although the housing 120 and the cover 130 are assembled after the branch wires 141 and the main wires 142 are separately accommodated therein, the cover 130 may be fitted on the housing 120 after the branch wires 141 and the main wires 142 are accommodated in the housing 120. By separately forming parts for accommodating the branch wires 141 and the main wires 142 as in this embodiment, the operation can be performed in different places and there is no likelihood that the wires are wrongly arranged.

As described above, in the housing 120 as a first casing, the parallel first grooves 121*a* to 121*d* and the parallel second grooves 122*a* to 122*d* are so formed as to intersect; the terminals 110 having the blade parts 111, 112 and/or the blade portions 111*a*, 112*a* of different heights or depths are pressed into the rectangular walls 123*a* to 123*d* at the intersections; and the branch wires 141 are accommodated in the grooves 121. On the other hand, in the cover 130 as a second casing, the first projections 131*a* to 131*d* and the second projections 132*a* to 132*d* to be opposed to the grooves 121, 122 are formed. The main wires 142 are held on the projections 132. When the cover 130 is fitted to cover the housing 120, the first projections 131 press the branch wires 141 into the grooves 121; the second projections 132 press the main wires 142 into the grooves 122; and the respective wires 141, 142 are pressed by the front and rear walls of the slots 133, 132 into the slits 111*a*1, 112*a*1 of the blade parts 111, 112 and/or the blade portions 111*a*, 112*a* to be connected with the blade parts 111, 112 and/or the blade portions 111*a*, 112*a*.

Since the wires to be connected can be arranged on the upper surfaces of the housing 120 and the cover 130, operability can be improved.

Figure 20:
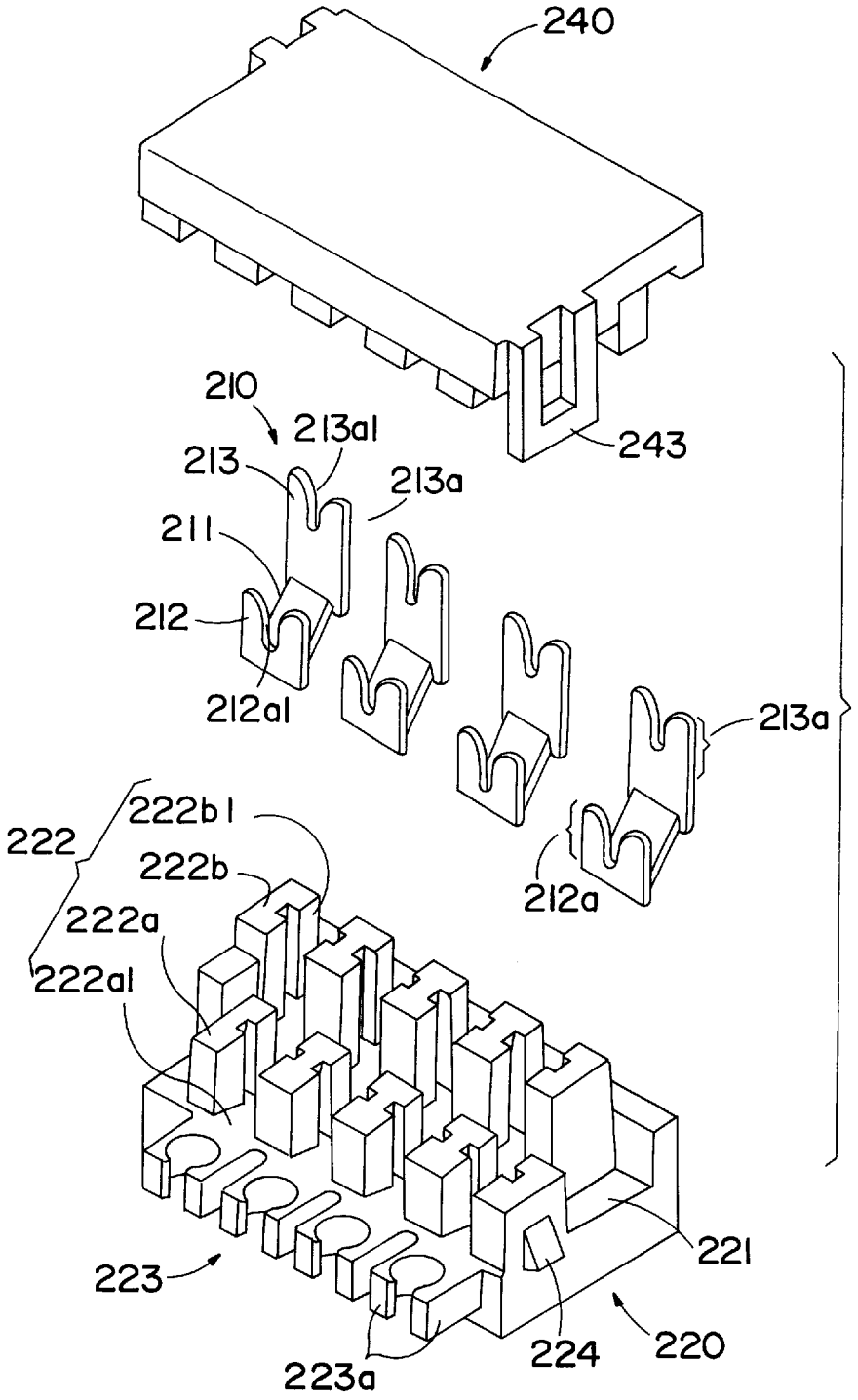
FIG. 20 is an exploded perspective view of a cramping connector according to a seventh embodiment of the invention.
Figure 21:
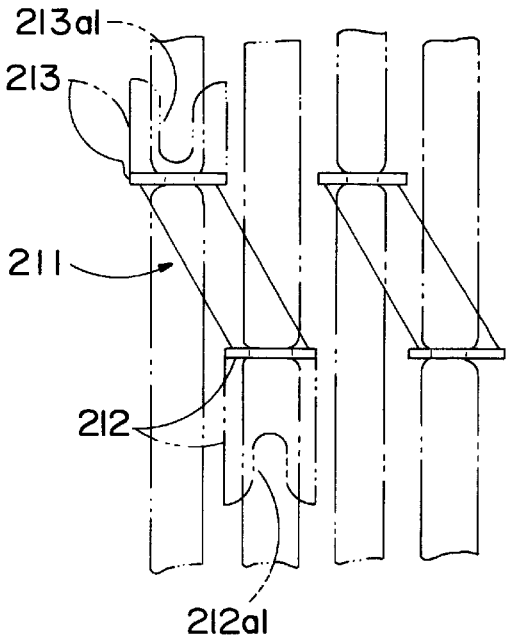
FIG. 21 is a plan view of terminals of the cramping connector.

In FIG. 20, a terminal 210 is formed by bending a strip 211 having obliquely extending opposite ends or ends extending at an angle with respect to a longitudinal direction of the strip as shown in FIG. 21 where slits 212*a*1, 213*a*1 are formed in the ends along a lengthwise direction thereof or from end faces toward the opposite sides substantially in the same direction by different lengths. Since the opposite ends of the terminal 210 has different lengths, the bent opposite ends form a lower blade part 212 and/or a lower blade portion 212*a* and a higher blade part 213 and/or a higher blade portion 213*a*, respectively. This height difference substantially corresponds to the thickness of wires to be connected. Since the wires are basically arranged in two vertical stages or planes, the heights of the blade parts 212, 213 and/or the blade portions 212*a*, 213*a* are differed by at least the thickness of the wires. However, the height difference may be larger than the thickness of the wires.

Since the blade parts 212, 213 and/or the blade portions 212*a*, 213*a* obliquely extend at the opposite ends of the strip, after being bent, they are parallel to each other along forward and backward directions and are slightly displaced along a lateral direction. A displacement distance is determined as follows. When a plurality of terminals 210 are arranged side by side and oriented in the same direction as shown in FIG. 21, the respective blade parts 212, 213 and/or the respective blade portions 212*a*, 213*a* are aligned along the lateral direction and the slits 212*a*, 213*a* are displaced in the corresponding blade parts 212, 213 and/or blade portions 212*a*, 213*a*. In other words, the slits 212*a*, 213*a* are alternately and equally arranged at the front and rear sides.

Figure 22:
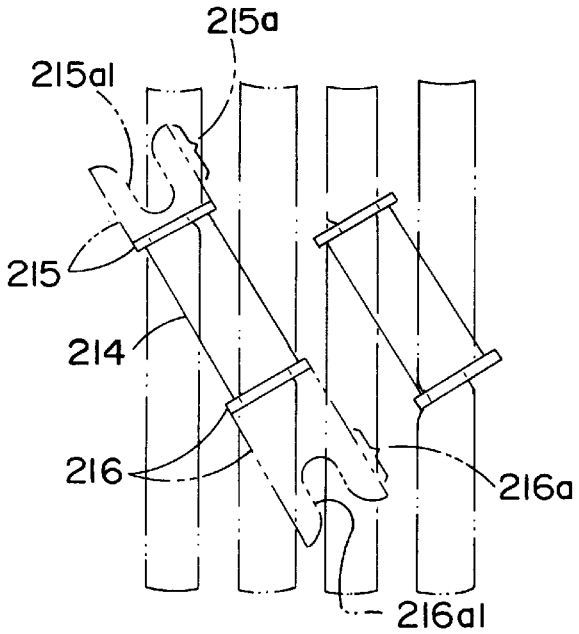
FIG. 22 is a plan view of terminals according to an eighth embodiment.
Figure 23:
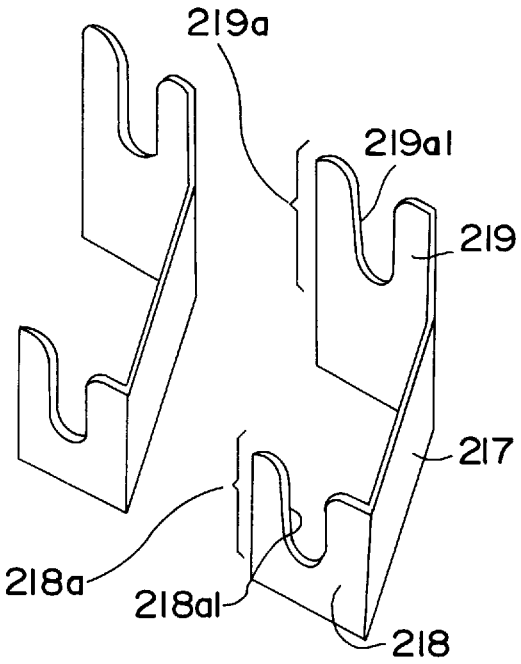
FIG. 23 is a perspective view of terminals according to a ninth embodiment.

Although the blade parts 212, 213 and/or the blade portions 212*a*, 213*a* of different heights or depths are formed using the strips 211 having obliquely extending opposite ends in this embodiment, the opposite ends may not necessarily be obliquely displaced. It is sufficient for the opposite ends to be displaced along the forward and backward directions. Accordingly, as shown in FIG. 22, lower and higher blade parts 215, 216 and/or the lower and higher blade portions 215*a*, 216*a* may be formed by forming slits 215*a*, 216*a* in the opposite ends of a linear strip 214 and bending the opposite ends substantially at right angles in the same direction by different lengths. Alternatively, as shown in FIG. 23, slits 218*a*, 219*a* extending in a direction normal to the length of a strip 217 may be formed in blade parts 218, 219 and/or in blade portions 218*a*, 219*a* before the opposite ends of the strip 217 are bent. In this way, the terminal may be suitably modified. Further, the blade parts may not necessarily be formed by bending the opposite ends of a strip. For example, blade parts and/or blade portions having different heights may be electrically connected by a wire or the like.

Figure 24:
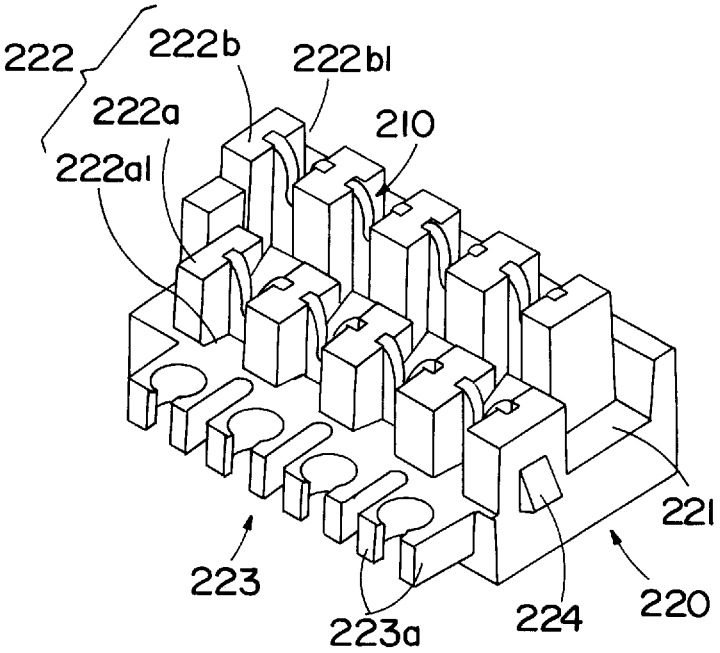
FIG. 24 is a perspective view of a first casing mounted with the terminals.

A first casing or housing 220 includes a terminal fixing portion 222 for fixing the terminals 210 on the upper surface of a substantially rectangular base 221, and a wire support portion 223 formed at its longer side for supporting branch wires 230. The terminal fixing portion 222 includes two front and rear wall portions 222*a*, 222*b* of different heights projecting in correspondence with the front and rear blade parts 212, 213 and/or the front and rear blade portions 212*a*,

213*a* of the terminals 210. Recesses 222*a*1, 222*b*1 into which the blade parts 212, 213 and/or the blade portions 212*a*, 213*a* are insertable are formed in the wall portions 222*a*, 222*b*, respectively. As the corresponding blade parts 212, 213 and/or blade portions 212*a*, 213*a* are displaced along the lateral direction, the recesses 222*a*1, 222*b*1 are also displaced along the lateral direction. E.g. four terminals 210 are mountable in the first casing 220 from above. Further, in the inner surfaces of the recesses 222*a*1, 222*b*1 are formed slots into which the edges of the blade parts 212, 213 and/or the blade portions 212*a*, 213*a* are inserted. FIG. 24 shows the first casing 220 in which the terminals 210 are mounted in the fixing portion 222.

Although the terminals 210 are supported in the recesses 222*a*1, 222*b*1 formed in two wall portions 222*a*, 222*b* in this embodiment, a support construction for the terminals 210 is not particularly limited to this. The support construction may have any suitable shape. For example, a portion of the terminal 210 connecting the blade parts 212, 213 and/or the blade portions 212*a*, 213*a* may be secured to the base 221. The support construction may be suitably modified so as to conform to the modification of the terminals 210 as described above. In the case that at least the lower wall portion 222*a* and recesses 222*a*1 are provided, the upper end of the wall portion 222*a* faces main wires 250 to be retained by a second casing 240 as described later so that the main wires 250 can be stably retained.

Figure 25:
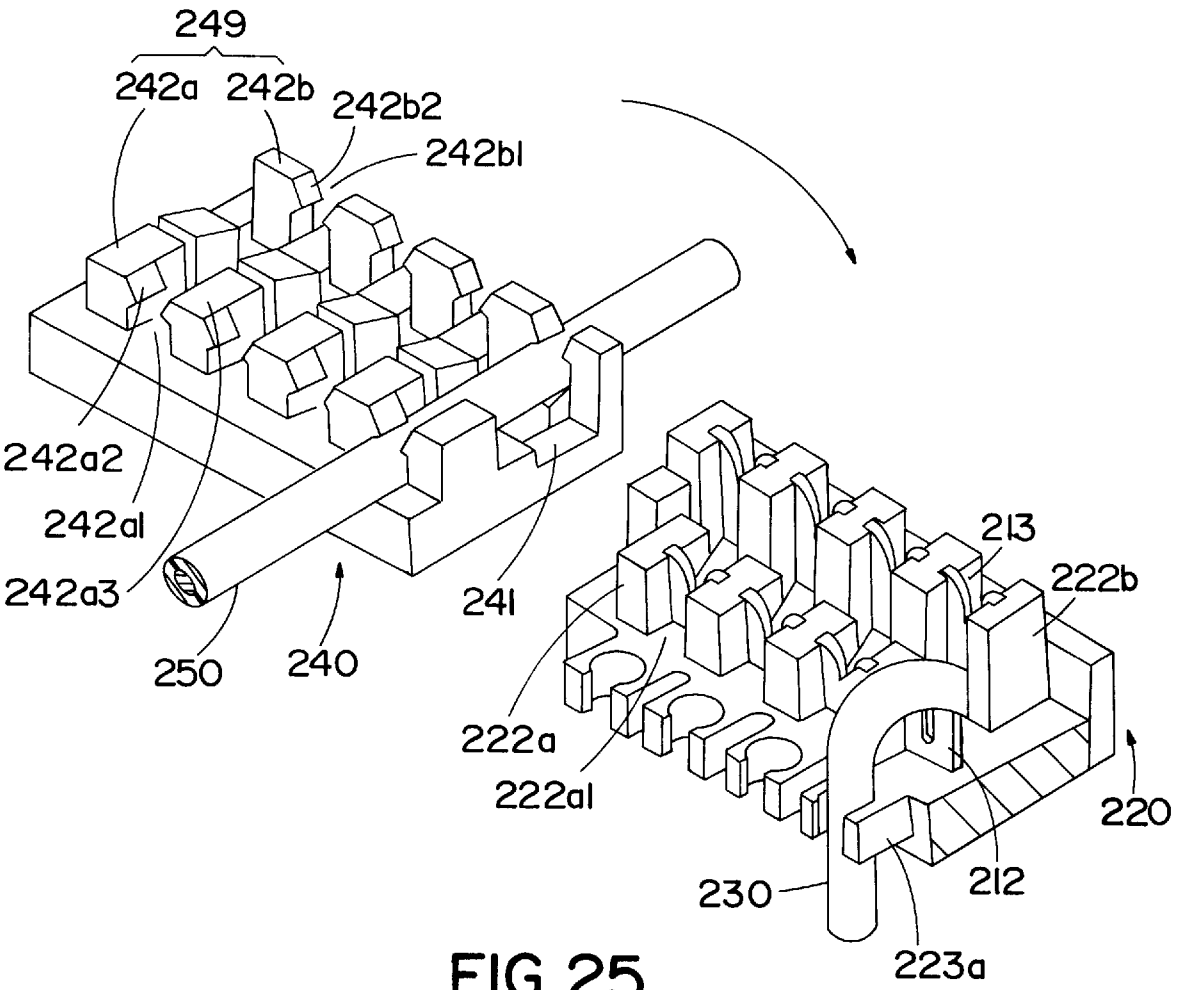
FIG. 25 is a perspective view of the first and second casings of the cramping connector with a branch wire and a main wire arranged therein, respectively.

The wire support portion 223 formed at the edge of the base 221 includes four forked portions 223*a* extending in parallel with the base 221. The branch wires 230 are supported by being inserted into the respective forked portions 223*a*. In this case, the branch wires 230 hang downward from the base 221 as shown in FIG. 25.

Figure 26:
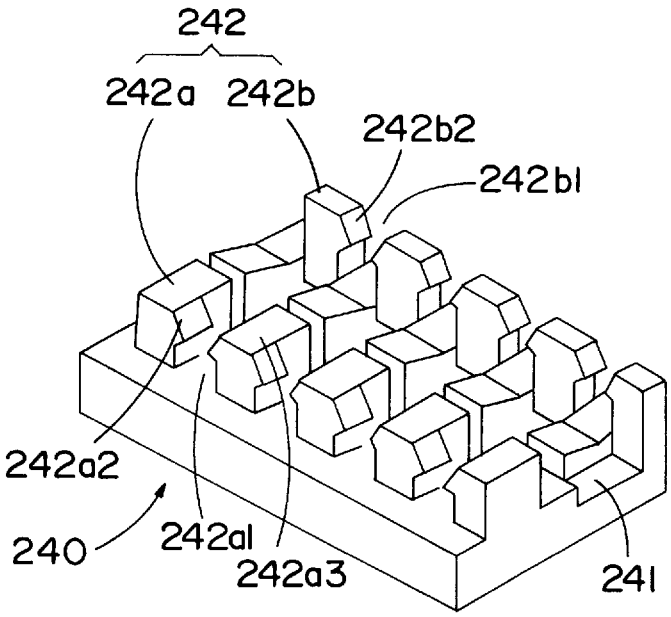
FIG. 26 is a perspective view of the rear surface of the second casing.
Figure 27:
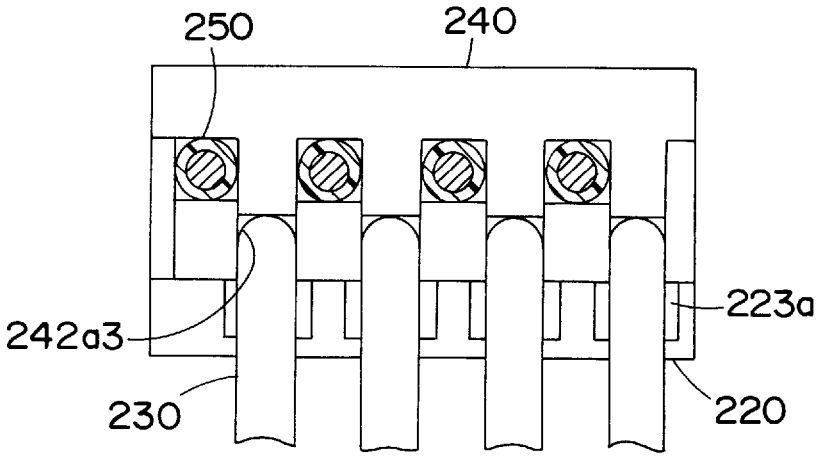
FIG. 27 is a front view showing relative positions of projections of the second casing.

The second casing 240 is fitted with the first casing 220 to form one casing. As shown in FIG. 26, the second casing 240 includes a base 241 for covering an upper portion of the first casing 220 and a wire support portion 242 for retaining main wires 250 on the base 241. Similar to the fixing portion 222, the wire support portion 242 includes two rows of wall portions 242*a*, 242*b*. Four recesses 242*a*1 and 242*b*1 are formed in the wall portion 242*a* and 242*b*. The corresponding recesses 242*a*1, 242*b* are linearly arranged along an axial direction, and small projections 242*a*2, 242*b*2 are formed on the opposing inner surfaces of the recesses 242*a*1, 242*b*1 so that the wires pressed into the recesses 242*a*1, 242*b*1 are locked therein. Since the corresponding recesses 242*a*2, 242*b*2 formed in the front and rear wall portions 242*a*, 242*b* are linearly arranged unlike the laterally displaced recesses 222*a*1, 222*b*1 formed in the front and rear wall portions 222*a*, 222*b* of the first casing 220, when the first and second casings 220, 240 are fitted while positioning the recesses 222*b*1, 242*b*1, the recesses 222*a*1, 242*a*1 are displaced from each other to be covered by the upper ends of the mating wall portions 242*a*, 222*a* as shown in FIG. 27. At this time, the upper end of the wall portion 242*a* of the second casing 240 acts as projections 242*a*3 to be opposed to the lower blade parts 212 and/or the lower blade portions 212*a* held by the first casing 220.

Figure 28:
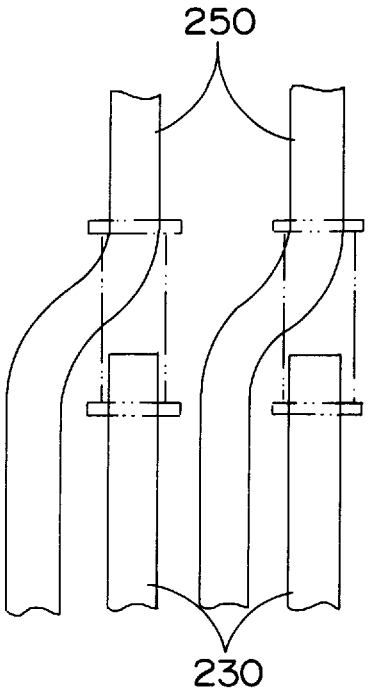
FIG. 28 is a plan view showing arranged branch and main wires according to a tenth embodiment.

Although the two wall portions 242*a*, 242*b* are formed one in front of the other in this embodiment, the second casing 240 may be suitably modified provided it is formed with the projections 242*a*3 to be opposed to the lower blade parts 212 and/or the lower blade portions 212*a* when the second casing 240 is fitted on the first casing 220. Further, the positions of the projections 242*a*3 may be suitably changed according to the arrangement of the branch wires 230 and the main wires 250. The main wires 250 are linearly held in this embodiment. However, as shown in FIG. 28, they may be held while being bent as with the terminals 210 described above. In such a case as well, it is sufficient to form projections to be opposed to the lower blade portions with which the branch wires 230 are to be connected. As is clear from the above example, it is sufficient to arrange the branch wires 230 and the main wires 250 obliquely to each other. To this end, an arrangement may be such as in FIG. 21 where the intermediate portions of the terminals 210 obliquely extend or such as in FIG. 22 where the terminals 210 themselves are obliquely arranged.

Loop- or frame-shaped locking arms 243 stand upright at shorter edges of the base 241 of the second casing 240, and wedge-shaped locking projections 224 engageable with the locking arms 243 are formed on the outer surfaces of the wall portions 222*a*, 222*b* of the first casing 220. Accordingly, when the first and second casings 220, 240 are moved closer to each other, the locking arms 243 and the locking projections 224 are lockingly engaged.

Although the casings 220, 240 are locked by the locking arms 243 and the locking projections 224 in this embodiment, other general locking constructions may also be adopted.

Next, how the embodiment thus constructed operates is described.

The terminals 210 are formed by bending the opposite ends of the strips 211 to form the blade parts 212, 213 carrying the blade portions 212*a*, 213*a*, the blade parts 212, 213 and/or the blade portions 212*a*, 213*a* having different heights at the opposite ends. The terminal 210 is mounted in the casing 220 by inserting the lower blade portion 212 into the recess 222*a*1 of the wall portion 222*a* while inserting the higher blade portion 213 into the recess 222*b*2 of the wall portion 222*b*. After mounting four terminals 210 in this manner, end portions of four branch wires 230 are pressed into the forked portions 223*a* formed at the wire support portion 223 while being placed on the lower blade parts 212 and/or the lower blade portions 212*a* held in the recesses 222*a*1.

On the other hand, in the second casing 240, the main wires 250 are pressed into the four recesses 242*a*1, 242*b*1 formed in the two front and rear wall portions 242*a*, 242*b*. When the first casing 220 and the second casing 240 retaining the branch wires 230 and the main wires 250 are fitted, the recesses 222*b*1 of the first casing 220 face the recesses 242*b*1 of the second casing 240. Accordingly, the main wires 250 are pressed against the higher blade parts 213 and/or the higher blade portions 213*a* of the terminals 210 to be connected therewith. On the other hand, the projections 242*a*3 which are projected portions of the wall portion 242*a* of the second casing 220 face the recesses 222*a*1 of the first casing 220, and press the ends of the branch wires 230 placed on the lower blade parts 212 and/or the lower blade portions 212*a* held in the recesses 222*a*1 to connect the branch wires 230 with the blade parts 212 and/or the blade portions 212*a*.

Figure 29:
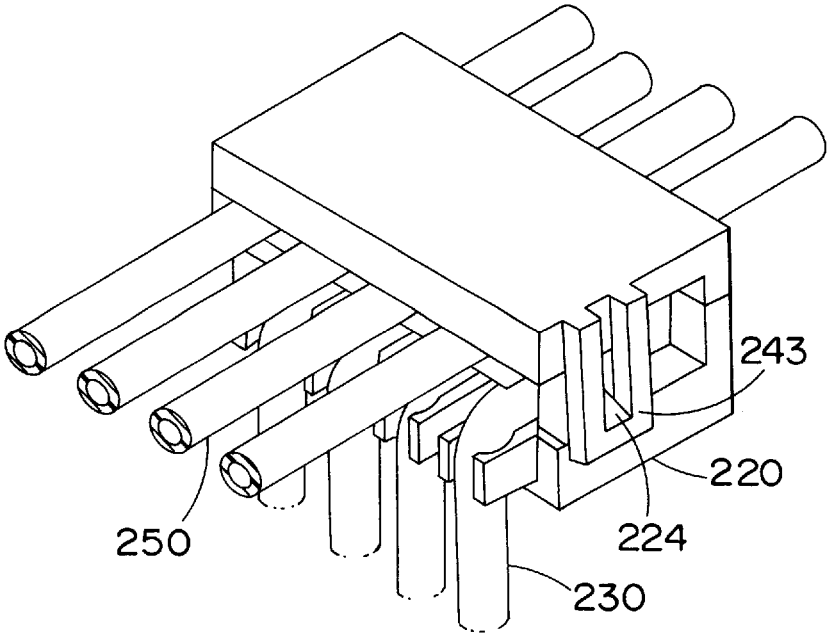
FIG. 29 is a perspective view of the cramping connector in its assembled state.

Immediately after the completion of the connection, the locking arms 243 of the second casing 240 are engaged with the locking projections 224 of the first casing 220 to lock the casings 220, 240. This state is shown in FIG. 29.

As described above, by fitting the first and second casing 220, 240, the branch wires 230 and the main wires 250 face the blade parts 212, 213 and/or the blade portions 212*a*, 213*a* of different heights while being arranged in two vertical stages. Simultaneously, the branch wires 230 and the main wires 250 are pressed against the blade parts 212, 213 and/or the blade portions 212*a*, 213*a* by the mating casing 240, 220 of those retaining the wires 230 and 250, and connected with the blade parts 212, 213 and/or the blade portions 212, 213, respectively. Accordingly, as compared with the case where the branch wires 230 and the main wires 250 are arranged side by side, the wires can be arranged in a more compact manner. If the wires are merely arranged in two vertical stages, the branch wires 230 and the main wires 250 are pressed against the lower blade parts 212 and/or the lower blade portions 212*a* one over the other. This may make it difficult to connect the wires with the blade portions because the wires have elasticity. In this embodiment, since the projections 242*a*3 to be opposed to the lower blade portions 212 are formed to press the branch wires 230 against the blade portions 212, the connection can be easily made.

The cramping connector is made more compact by differing the heights of the blade parts and/or blade portions of the terminals in the foregoing embodiments. However, in an embodiment shown in FIGS. 30 to 36, blade parts 362, 363 having (or including or carrying) blade portions 362*a*, 363*a* of each terminal 360 are shifted only along forward and backward directions and have the same height. In (or on or at) the blade parts 362, 363 and/or in the blade portions 362*a*, 363*a* are formed slits 362*a*1, 363*a*1. The terminal 360 is basically formed similar to the previous terminals except that the heights of the blade parts 362, 363 and/or the blade portions 362*a*, 363*a* are same. The front and rear blade parts 362, 363 and/or the front and rear blade portions 362*a*, 363*a* are shifted along a lateral direction while being opposed in parallel, and an obliquely extending strip 361 connects the blade parts 362, 363. It should be appreciated that the invention is not necessarily limited to this embodiment since the blade parts 362, 363 and/or the blade portions 362*a*, 363*a* only need to be shifted along the forward and backward directions. Thus, the terminal 360 may be formed similar to the previous ones .

Figure 31:
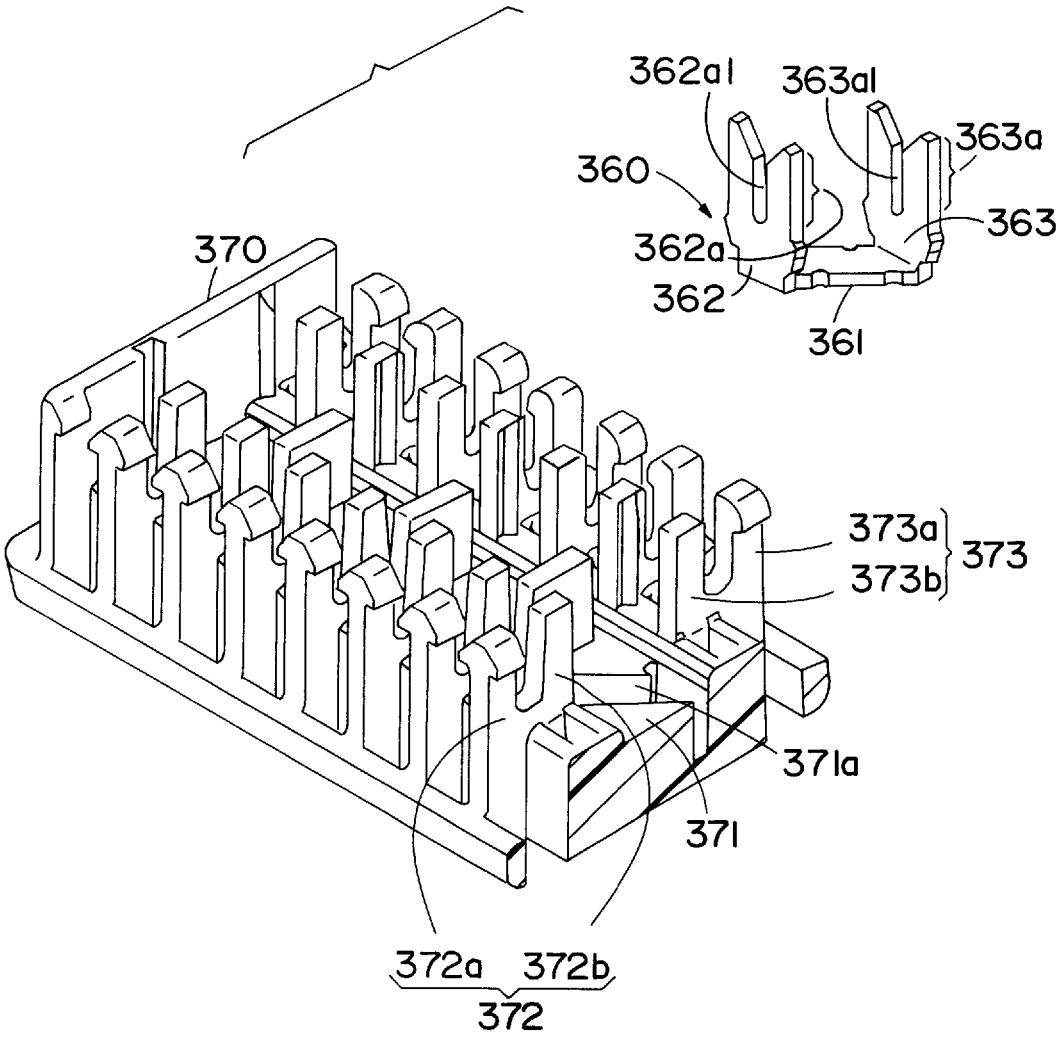
FIG. 31 is an exploded perspective view partly in section of a lower casing of the cramping connector of FIG. 30.
Figure 32:
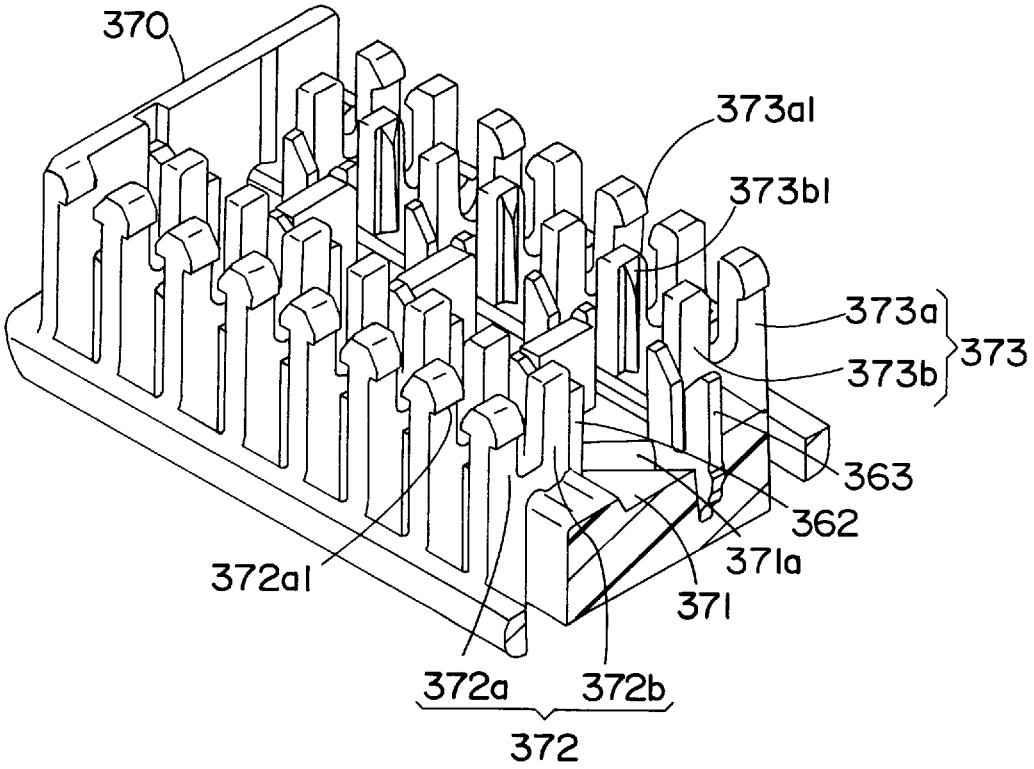
FIG. 32 is a perspective view partly in section of the lower casing of the cramping connector of FIG. 30.

The terminals 360 are accommodated in a housing including a pair of casings: a lower casing 370 and an upper casing 380. Specifically, recesses 371*a* used to accommodate the terminals 360 are formed in an inner bottom surface 371 of the lower casing 370 as shown in FIG. 31, and one terminal 360 is mounted and held in each recess 371*a* as shown in FIG. 32. Four obliquely extending recesses 371*a* are formed. Accordingly, the blade parts 362, 363 and/or the blade portions 362*a*, 363*a* of the accommodated terminals 360 are alternately arranged in front and rear rows. In other words, a blade part 363 and/or a blade portion 363*a* is located between two adjacent blade parts 362 and/or blade portions 362*a*, and a blade part 362 and/or a blade portion 362*a* is located between two adjacent blade parts 363 and/or blade portions 363*a*. By alternately arranging the blade parts 362, 363 and/or the blade portions 362*a*, 363*a* in the front and rear rows along the lateral direction, the cramping connector can be made narrower as compared with the one in which the blade parts and/or the blade portions are arranged side by side in one row.

Figure 33:
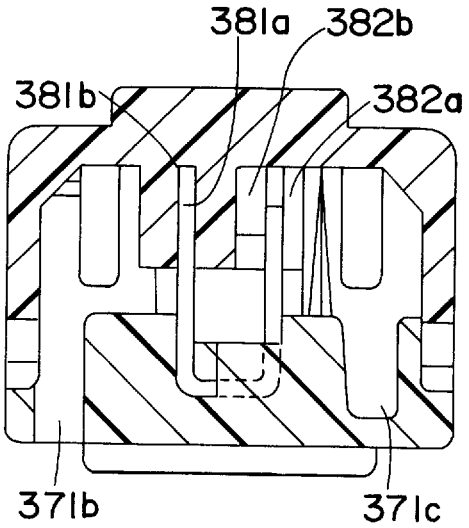
FIG. 33 is a section of the cramping connector of FIG. 30 when no branch wire is set.
Figure 34:
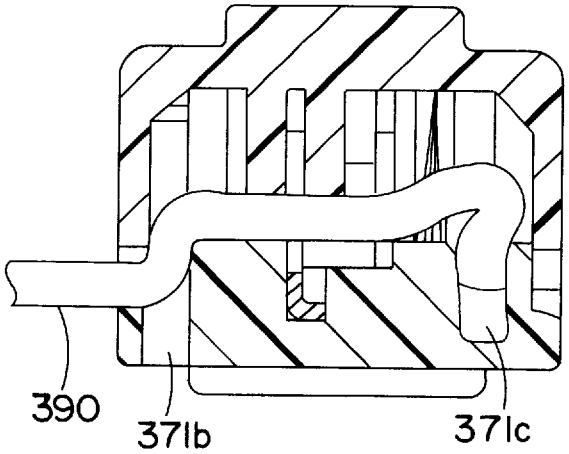
FIG. 34 is a section of the cramping connector of FIG. 30 when a branch wire is set.

Comb-like ribs 372 (372*a*, 372*b*) and 373 (373*a*, 373*b*) for guiding branch wires 390 and main wires 400 into the respective blade parts 362, 363 and/or blade portions 362*a*, 363*a* are formed in the casing 370. The branch and main wires 390, 400 are alternately inserted between adjacent ribs 372, but only the main wires 400 are inserted between adjacent ribs 373 since the leading ends of the branch wires 390 are pressed into recesses 371*c* formed in the inner bottom surface 371 as shown in FIGS. 33 and 34. The terminals 360 are mounted such that the blade parts 362, 363 and/or the blade portions 362*a*, 363*a* thereof are substantially normal to the branch and main wires 390, 400 inserted between the ribs 372 and between the ribs 373. At portions of the respective ribs 372*a*, 373*a* where the branch and main wires 390, 400 are inserted, there are formed projections 372*a*1, 373*a*1 for preventing the wires 390, 400 from coming out. The branch and main wires 390, 400 inserted between the ribs 372 and between the ribs 373 after the terminals 360 are mounted in the casing 370 are partly locked, i.e. being prevented from coming out. Further, a line of projections 373*b*1 is formed on one side surface of each rib 373*b*. The projections 373*b*1 cut in and/or deform the insulation coating of the branch wires 390 from opposite sides so as to prevent the branch wires 390 from coming out. The branch wires 390 are bent substantially at 90° after having their leading ends pressed into the recesses 371*c*, and further held between the projections 373*b*1. Portions of the branch wires 390 spaced from their leading ends are urged into the space 371*b* to ensure that the branch wires 390 reach a specified depth in the terminals 360, as shown by FIGS. 33 and 34. Thus, the branch wires 390 cannot easily come out.

Figure 35:
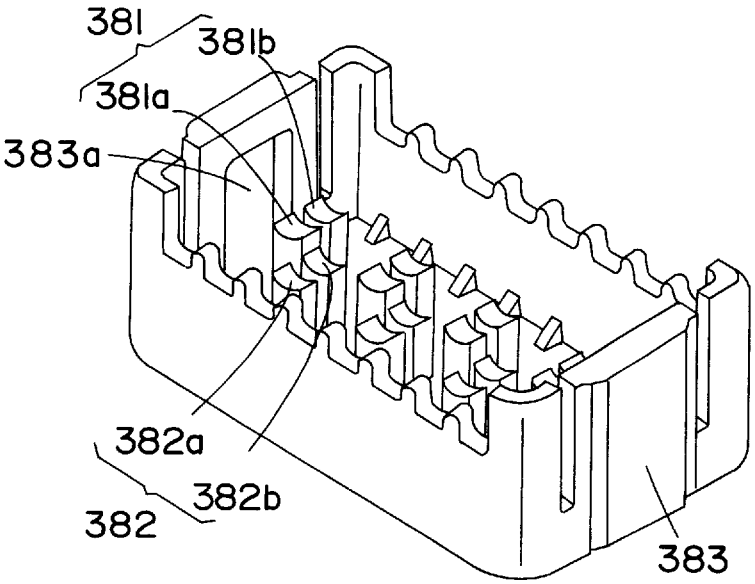
FIG. 35 is a perspective of an upper casing of the cramping connector of FIG. 30 when viewed from below.

On the other hand, the upper casing 380 is so formed as to cover the upper surface of the lower casing 370. As shown in FIG. 35, wire pressing portions 381, 382 in the form of projections are so formed on the rear surface of the upper casing 380 as to correspond to the respective blade parts 362, 363 and/or blade portions 362*a*, 363*a*. The end face of each of the wire pressing portions 381, 382 has a substantially concave shape so that the wire pressing portion 381 or 382 can press the branch wire 390 or main wire 400 down while holding it. Further, each of the wire pressing portions 381, 382 includes preferably two pressing portions 381*a*, 381*b* (or 382*a*, 382*b*) so that the wire 390 or 400 can be pressed down preferably at the opposite sides of the plate-like blade parts 362 or 363 and/or blade portions 362*a* or 363*a*. Thus, when the upper casing 380 is mounted and pressed after the branch and main wires 390, 400 are partly locked on the casing 370, each wire pressing portion 381 presses the branch wire 390 into the slit of the corresponding blade part 362 and/or in the blade portion 362*a*, thereby establishing a contact between the branch wire 390 and the blade part 362 and/or the blade portion 362*a*, whereas each wire pressing portion 382 presses the main wire 400 into the slit of the corresponding blade part 363 and/or blade portion 363*a*, thereby establishing a contact between the main wire 400 and the blade part 363 and/or the blade portion 363*a*.

Figure 36:
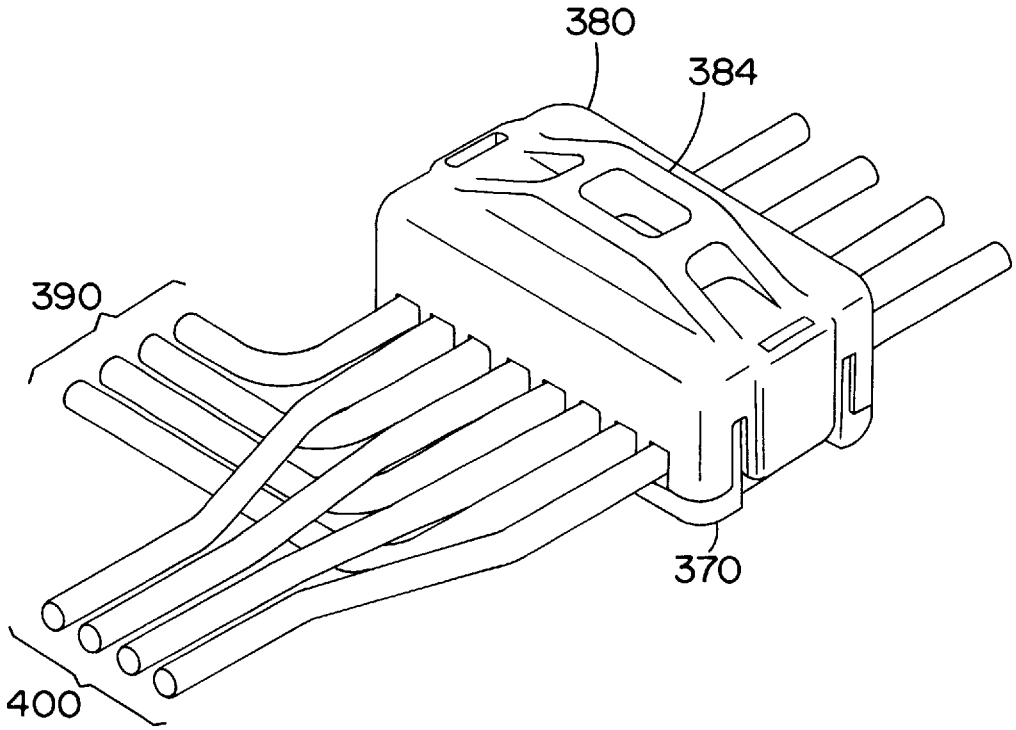
FIG. 36 is a perspective of the cramping connector of FIG. 30 in its assembled state.
Figure 37:
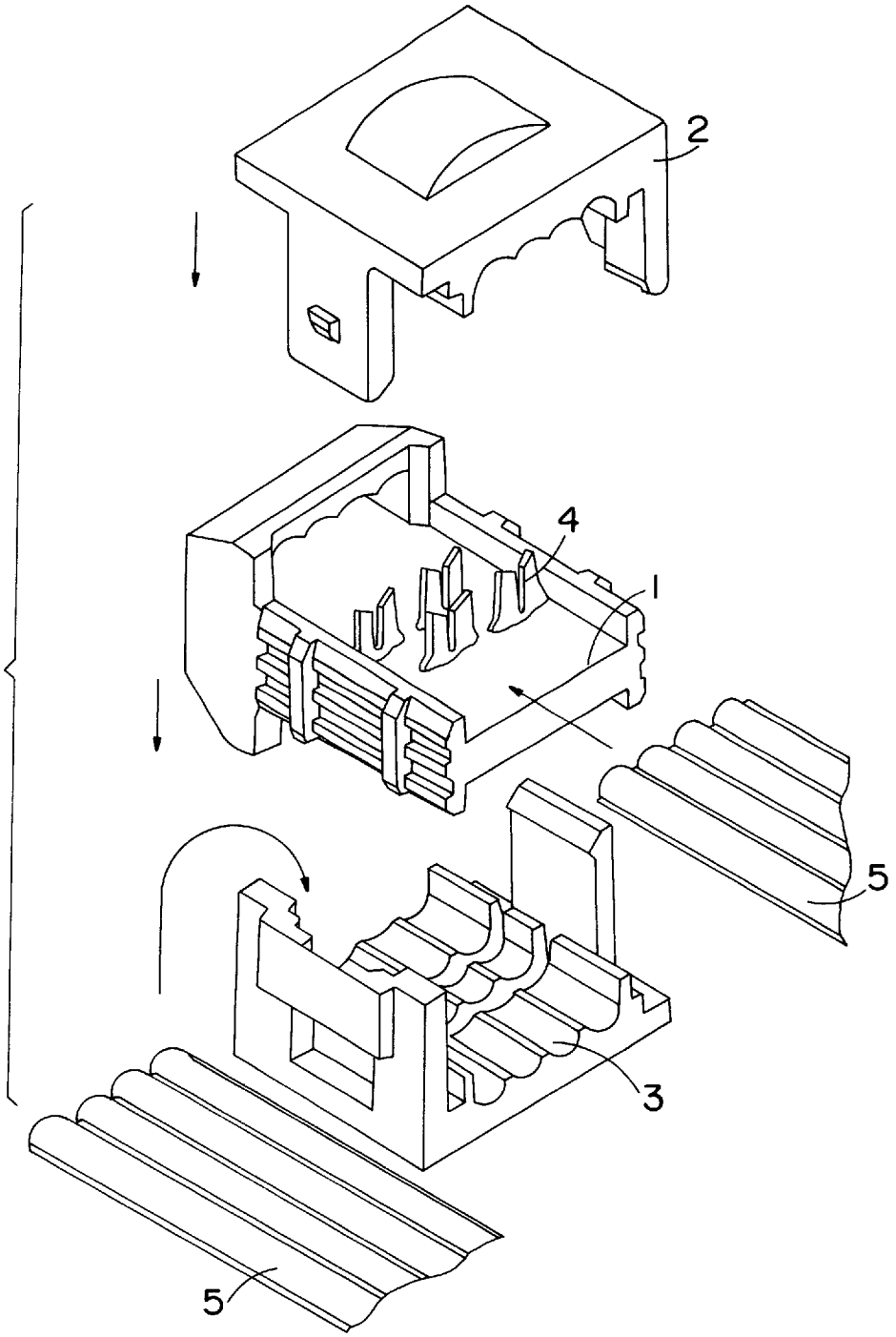
FIG. 37 PRIOR ART
FIG. 37 is an exploded perspective view of a prior art cramping connector.

Engaging projections 375*a*, 375*b* are formed one above the other on each of side walls 374 of the lower casing 370 where the ribs 372, 373 are not formed, and an engaging recess 383*a* is formed in an inner surface of each corresponding side wall 383 of the upper casing 380. As the upper casing 380 is mounted, the upper engaging projections 375*a* are first engaged with the edges of the recesses 383*a* (partial engagement). When the upper casing 380 is further pressed down, the lower engaging projections 375*b* are engaged with the edges of the recesses 383*a* (full engagement). In this way, as shown in FIG. 36, the lower and upper casings 370, 380 are assembled, and the branch and main wires 390, 400 come out of the cramping connector while densely being arranged. Accordingly, the cramping connector is, as a whole, narrower.

A pressing device 410 (FIG. 30) such as pliers is used to press the upper casing 380 to fit it to the lower casing 370. In the case of the embodiment shown in FIGS. 30 to 36, a fittable portion 384 in the form of recesses and projections conforming to the shape of a pressing surface of the pressing device 410 is formed on the bottom surface (not shown) of the lower casing 370 and on the upper surface of the upper casing 380. When the lower and upper casings 370, 380 are pinched by the pressing device 410 , the recesses and projections formed on the pressing surfaces of the pressing device 410 are fitted to the fittable portions 384 formed on the bottom surface of the lower casing 370 and on the upper surface of the upper casing 380, with the result that the projections are fitted into the corresponding recesses. Accordingly, the assembling of the lower and upper casings 370, 380 can be completed without any displacement in the lateral direction.

Figure 30:
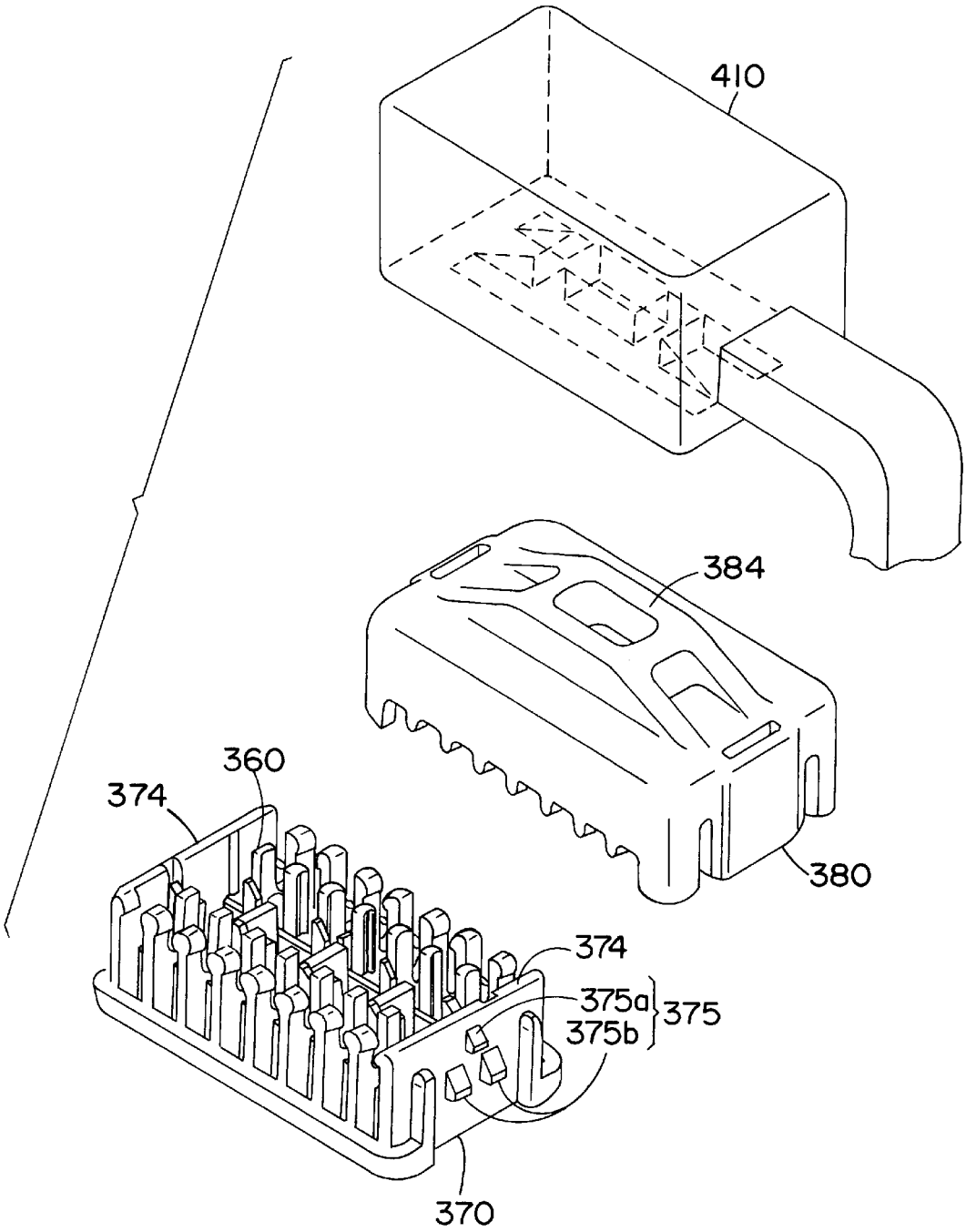
FIG. 30 is a perspective view of a cramping connector as another modification.

The fittable portion 384 needs not have a shape as shown in FIG. 30 provided it prevents a displacement in a direction substantially normal to a pressing direction in which the lower and upper casings 370, 380 are pressed by the pressing device 410. For example, the pressing device 410 may have concave surfaces while the lower and upper casings 370, 380 may have a convex bottom surface and a convex upper surface, respectively. Conversely, the pressing device 410 may have convex surfaces while the lower and upper casings 370, 380 may have a concave bottom surface and a concave upper surface, respectively. The corresponding concave and convex shapes need not be constantly in contact. Portions to be pressed may gradually change as the pressing surfaces are moved, while making an arcuate trace, to press the lower and upper casings 370, 380 as with pliers. It is not necessary to form a recess or projection at both the lower casing 370 and the upper casing 380. If a recess or projection in conformity with the shape of the pressing surface is formed at least at one of the lower and upper casings 370, 380, a lateral displacement can be prevented, thereby improving operability.

As described above, by assembling the first casing and the second casing , the branch wires and the main wires are so arranged one above the other as to face the blade parts and/or blade portions having different heights. The branch wires and the main wires are pressed against the blade parts and/or the blade portions by the mating casings of the casings holding them, and connected therewith. Accordingly, as compared with the case where the branch wires and the main wires are arranged side by side, the cramping connector can be made more compact. If the branch wires and the main wires are simply arranged in two stages one above the other, it may be difficult to connect the wires with the lower blade part and/or the lower blade portions due to the elasticity of the wires. However, since the projections are so formed as to face the lower blade parts and/or the lower blade portions and to press the wires against the lower blade parts and/or the lower blade portions , the connection are easily attainable. Even with the terminals 360 having the blade parts and/or the blade portions 362, 363 only shifted along the forward and backward directions, the cramping connector can be made more compact as compared with the case where the blade parts and/or the blade portions are arranged side by side in a row although it is not as compact as in the case where the branch and main wires are arranged in two stages one above the other.

What is claimed is:

1. A terminal for a cramping connector, said terminal being formed from an elongate unitary strip of metallic material having opposed ends, the strip being bent in proximity to each said end to define a pair of parallel blade parts (362, 363) and an intermediate part (361) extending between the blade parts (362, 363), each said blade part (362, 363) having a wire receiving slit (362*a*1, 363*a*1) extending toward said intermediate part (361) to define a wire inserting direction, each said wire receiving slit (362*a*1, 363*a*1) defining a wire engaging position along said wiring inserting direction, said intermediate part (361) having a longitudinal axis that is obliquely aligned to the blade parts (362, 363) such that said wire engaging positions of the respective blade parts (362, 363) are offset transverse to said wire inserting direction by a distance such that a wire passing through the wire receiving slit (362*a*1, 363*a*1) of either of said blade parts (362, 363) will pass substantially adjacent the other of said blade parts (362, 363), and such that respective wires engaged in the wire receiving slits (362*a*1, 363*a*1) are arranged substantially side by side.

2. The terminal according to claim 1, wherein the terminal is for use with wires of a specified thickness, the blade parts (362, 363) defining heights at least equal to or greater than the thickness of the wires.

3. A terminal according to claim 1, wherein the slits have different respective lengths.

4. The terminal according to claim 3, wherein the lateral side is of stepped configuration for achieving said different heights.

5. A cramping connector for a plurality of branch wires (390) and a plurality of main wires (400), comprising:

a plurality of terminals 360), each said terminal (360) having an elongate connecting strip (361) and each end of said strip being bent to define first and second parallel blade parts (362, 363), said first and second blade parts (362, 363) each having a pair of spaced apart blade portions (362*a*, 363*a*) defining a wire receiving slit (362*a*1, 363*a*1) therebetween, each said wire receiving slit (362*a*1, 363*a*1) defining a wire inserting direction and at least one wire engaging position along said wire inserting direction, said connecting strip having a longitudinal axis (361) being obliquely aligned relative to the blade parts (362, 363) such that said wire engaging positions of the respective blade parts (362, 363) are offset from one another in directions transverse to said wire inserting direction, and a housing (370, 380) for retaining the terminals (360) and for positioning the plurality of branch and main wires (390, 400) adjacent one another, the housing including means for pressing the branch wires (390) into the wire receiving slit (362*a*1) of the first blade part (362) and means for pressing the main wires (400) into the wire receiving slit (363*a*1) of the second blade Part (363), the housing (370, 380) further including means for permitting each of said main wires (400) to pass entirely therethrough and means (371*c*) for retaining ends of said branch wire (390) within said housing (370, 380).

6. The cramping connector according to claim 5, wherein the housing is configured for positioning the plurality of wires one over the other.

7. The cramping connector according to claim 5, wherein the housing comprises first and second casings (370, 380), the first casing (370) comprising means (371*a*) for retaining and positioning the terminals (360) therein, and the second casing (380) defining the means for pressing the wires.

8. A cramping connector according to claim 7, wherein the blade portions (212*a*, 213*a*; 215*a*, 216*a*; 218*a*, 219*a*; 362*a*, 363*a*) are obliquely arranged in the housing (220, 240; 370, 380).

9. The cramping connector according to claim 5, wherein the means (371*c*) for retaining the end of the branch wire (390) comprises at least one closed-bottom recess (371*c*).

10. The cramping connector according to claim 9, wherein the first casing (370) comprises a plurality of ribs (372, 373) for guiding said branch and main wires (390, 400) into the respective wire receiving slits (362*a*1, 363*a*1) of the terminals (360).

11. The cramping connector according to claim 10, wherein portions of the ribs (373*b*) for receiving said branch wires (390) include projections (373*b*1) dimensioned and configured for gripping opposite sides of the respective branch wires (390) for holding said branch wires (390) within said first casing (370).

* * * * *